US011763734B2

(12) United States Patent
Zhou et al.

(10) Patent No.: US 11,763,734 B2
(45) Date of Patent: Sep. 19, 2023

(54) DISPLAY PANEL AND DISPLAY APPARATUS

(71) Applicants: WUHAN TIANMA MICROELECTRONICS CO., LTD., Wuhan (CN); Wuhan Tianma Microelectronics Co., Ltd. Shanghai Branch, Shanghai (CN)

(72) Inventors: Xingyao Zhou, Wuhan (CN); Yana Gao, Wuhan (CN); Wei Liu, Wuhan (CN); Kang Yang, Shanghai (CN); Jian Kuang, Wuhan (CN)

(73) Assignees: WUHAN TIANMA MICROELECTRONICS CO., LTD., Wuhan (CN); Wuhan Tianma Microelectronics Co., Ltd. Shanghai Branch, Shanghai (CN)

( * ) Notice: Subject to any disclaimer, the term of this patent is extended or adjusted under 35 U.S.C. 154(b) by 0 days.

(21) Appl. No.: 17/833,385

(22) Filed: Jun. 6, 2022

(65) Prior Publication Data

US 2022/0301499 A1 Sep. 22, 2022

(30) Foreign Application Priority Data

Dec. 30, 2021 (CN) ..... 202111646622.8

(51) Int. Cl.
*G09G 3/00* (2006.01)
*G09G 3/32* (2016.01)

(52) U.S. Cl.
CPC ..... *G09G 3/32* (2013.01); *G09G 3/006* (2013.01); *G09G 2300/0809* (2013.01); *G09G 2330/12* (2013.01)

(58) Field of Classification Search
CPC .. G09G 3/32; G09G 3/006; G09G 2300/0809; G09G 2330/12; G09G 5/022;
(Continued)

(56) References Cited

U.S. PATENT DOCUMENTS 8,159,645 B2 * 4/2012 Akiyama ..... G02F 1/1345 349/149
2003/0227078 A1 * 12/2003 Chang ..... G02F 1/1345 257/693

(Continued)

FOREIGN PATENT DOCUMENTS

CN 100468502 C 3/2009
CN 107134258 B 10/2019
CN 111583865 A 8/2020

OTHER PUBLICATIONS

Vaibhav Venugopal Rao/Ioannis Savidis, Mesh Based Obfuscation of Analog Circuit Properties, 2019, IEEE, p. 2.*

*Primary Examiner* — Jose R Soto Lopez
(74) *Attorney, Agent, or Firm* — CHRISTENSEN O'CONNOR JOHNSON KINDNESS PLLC

(57) ABSTRACT

A display panel and a display apparatus are provided. The display panel includes data lines located in a display region, and a power bus, connection traces, and a control circuit that are located in a non-display region. The connection trace at least partially overlaps with the power bus in a direction perpendicular to a plane of the display panel, and has a first area that is an overlapping area between the connection trace and the power bus. The control circuit includes control transistors. A first electrode and/or a second electrode of the control transistor is coupled to the connection trace. The control transistors include a first control transistor and a second control transistor. The connection trace coupled to the first control transistor and the connection trace coupled to the second control transistor have different first areas. Channel areas of the first control transistor and the second control transistor are different.

15 Claims, 15 Drawing Sheets

(58) Field of Classification Search
CPC ..... G09G 2320/0223; G09G 2230/00; G09G 2300/0408; G09G 2300/0426; G09G 2310/027
See application file for complete search history.

(56) References Cited

U.S. PATENT DOCUMENTS

2006/0123293 A1* 6/2006 Kim ..... G09G 3/3291 714/724
2008/0203391 A1* 8/2008 Kim ..... G09G 3/3611 257/E27.111
2012/0218316 A1* 8/2012 Wang ..... G09G 3/3688 345/89
2013/0057565 A1* 3/2013 Choi ..... G09G 3/2096 345/547
2014/0110852 A1* 4/2014 Yoshida ..... G02F 1/13452 257/773
2015/0123961 A1* 5/2015 Park ..... G09G 3/3614 345/212
2016/0181349 A1* 6/2016 Cho ..... H10K 59/88 257/40
2016/0293099 A1* 10/2016 Hack ..... G09G 3/3275
2018/0052372 A1* 2/2018 Xu ..... H01L 27/0266
2018/0101078 A1* 4/2018 Xian ..... G02F 1/1345
2018/0330653 A1* 11/2018 Zhou ..... H01L 27/124
2019/0020311 A1* 1/2019 Kang ..... H03D 7/1466
2019/0310509 A1* 10/2019 Shin ..... H01L 27/1255
2019/0324332 A1* 10/2019 Kang ..... H01L 27/0296
2020/0074955 A1* 3/2020 Fujikawa ..... G02F 1/1345
2020/0168173 A1* 5/2020 Adachi ..... G09G 3/3677
2020/0184900 A1* 6/2020 Shin ..... G09G 3/3233
2020/0212910 A1* 7/2020 Liu ..... H03K 17/6871
2020/0243021 A1* 7/2020 Li ..... G09G 3/3266
2020/0312209 A1* 10/2020 Yang ..... G09G 3/20
2020/0327834 A1* 10/2020 Kim ..... G09G 3/006
2020/0394951 A1* 12/2020 Li ..... G09G 3/20
2021/0035521 A1* 2/2021 Qiu ..... G09G 3/3275
2021/0119446 A1* 4/2021 Lin ..... H01L 27/0285
2021/0202663 A1* 7/2021 Yang ..... H10K 59/1213
2022/0189411 A1* 6/2022 Kim ..... G09G 3/3275
2022/0208093 A1* 6/2022 Keum ..... G09G 3/3233
2022/0328574 A1* 10/2022 Jiang ..... H01L 23/544
2022/0366842 A1* 11/2022 Kwon ..... G09G 3/3275

* cited by examiner

DISPLAY PANEL AND DISPLAY APPARATUS

CROSS-REFERENCE TO RELATED APPLICATIONS

The present application claims the benefit of Chinese Patent Application No. 202111646622.8, filed on Dec. 30, 2021, the content of which is incorporated herein by reference in its entirety.

TECHNICAL FIELD

The present disclosure relates to the technical field of displays, and in particular, to a display panel and a display apparatus.

BACKGROUND

A display panel includes data lines disposed in a display region. The data lines are electrically connected to connection traces in a non-display region and pixel circuits in the display region. Voltage signals are transmitted from the connection traces to the data lines and then to the pixel circuits, so as to control the pixel circuits to drive light-emitting elements to emit light.

In the related art, different connection traces have different load thereon, and the voltage variations on different connection traces are different from each other when the voltage signals are transmitted on these connection traces, leading to differences in voltage signals transmitted to the data lines and affecting the screen display.

SUMMARY

According to one aspect, the embodiments of the present disclosure provide a display panel. The display panel has a display region and a non-display region surrounding the display region. The display panel includes data lines located in the display region, a power bus located in the non-display region, connection traces located in the non-display region and coupled to the data lines, and a control circuit located in the non-display region and including control transistors. Each of the connection traces at least partially overlaps with the power bus in a directions perpendicular to a plane of the display panel, and has a first area that is an overlapping area between the connection trace and the power bus. At least one of a first electrode or a second electrode of one of the control transistors is coupled to one of the connection traces. The control transistors include a first control transistor and a second control transistor. The first area of one of the connection traces that is coupled to the first control transistor is different from the first area of another one of the connection traces that is coupled to the second control transistor. The first control transistor and the second control transistor have different channel areas.

According to another aspect, the embodiments of the present disclosure provide a display apparatus including a display panel. The display panel has a display region and a non-display region surrounding the display region. The display panel includes data lines located in the display region, a power bus located in the non-display region, connection traces located in the non-display region and coupled to the data lines, and a control circuit located in the non-display region and including control transistors. Each of the connection traces at least partially overlaps with the power bus in a direction perpendicular to a plane of the display panel, and has a first area that is an overlapping area between the connection trace and the power bus. At least one of a first electrode or a second electrode of one of the control transistors is coupled to one of the connection traces. The control transistors include a first control transistor and a second control transistor. The first area of one of the connection traces that is coupled to the first control transistor is different from the first area of another one of the connection traces that is coupled to the second control transistor. The first control transistor and the second control transistor have different channel areas.

BRIEF DESCRIPTION OF DRAWINGS

In order to more clearly describe the embodiments of the present disclosure or the technical solution in the related art, the drawings used in the description of the embodiments or the related art will be briefly described below. The drawings in the following description are some embodiments of the present disclosure. Those skilled in the art can obtain other drawings based on these drawings.

DESCRIPTION OF EMBODIMENTS

To better understand the technical solutions of the present disclosure, some embodiments of the present disclosure are described in detail below with reference to the accompanying drawings.

It can be understood that the embodiments in the following descriptions are some embodiments rather than all of the embodiments in the present disclosure. All other embodiments obtained by those ordinarily skilled in the art based on the embodiments of the present disclosure should also fall within the scope of the present disclosure.

Terms in the embodiments of the present disclosure are merely used to describe the specific embodiments, and are not intended to limit the present disclosure. Unless otherwise specified in the context, words, such as "a", "the", and "this", in a singular form in the embodiments of the present disclosure and the appended claims include plural forms.

It should be understood that the term "and/or" in this specification merely describes associations between associated objects, and it indicates three types of relationships. For example, A and/or B may indicate A alone, A and B, or B alone. The character "/" in this specification generally indicates that the associated objects are in an "or" relationship.

Figure 1:
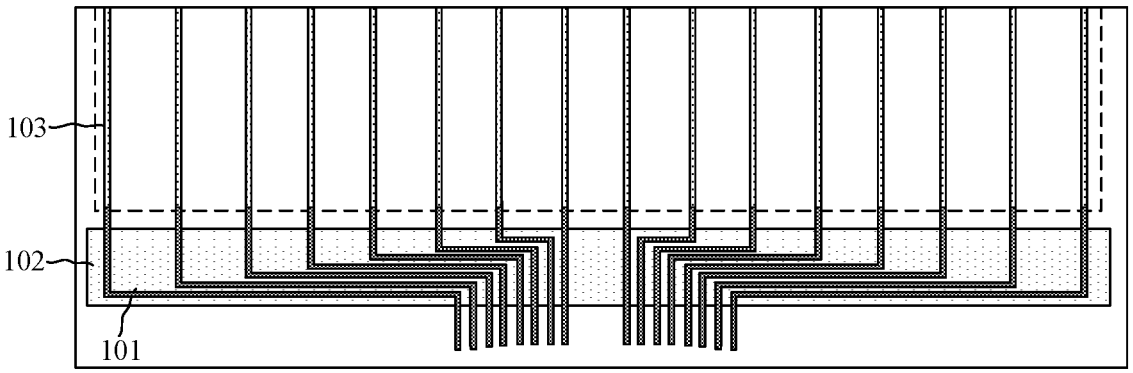
FIG. 1 (PRIOR ART)
FIG. 1 is a schematic diagram of overlapping between connection traces and a power bus in the prior art.

To reduce the bezel width of a display panel, connection traces located in a non-display region inevitably overlap with a power bus. FIG. 1 is a schematic diagram of overlapping between connection lines and a power bus in the related art. As shown in FIG. 1, as connection traces 101 at different positions have different overlapping areas with the power bus 102, different connection traces 101 have different loads, which leads to different voltage variations of voltage signals when transmitted on different connection traces 101, thus causing the voltage signals transmitted to data lines 103 to be different.

For example, before the display panel leaves the factory, a screen lighting test is generally performed on the display panel, to verify the display performance of the display panel. During the screen lighting test, a test voltage signal provided by a test terminal is further transmitted to the data lines 103 through the connection traces 101. If the test voltage signal has different voltage variations when transmitted on the connection traces 101, different test voltage signals will be inputted to different data lines 103, resulting in display non-uniformity or a Moore phenomenon of a test image, thus affecting product evaluation.

Accordingly, some embodiments of the present disclosure provide a display panel, which solve the problem of different voltage signals transmitted on the data lines due to the load difference of the connection traces.

Figure 2:
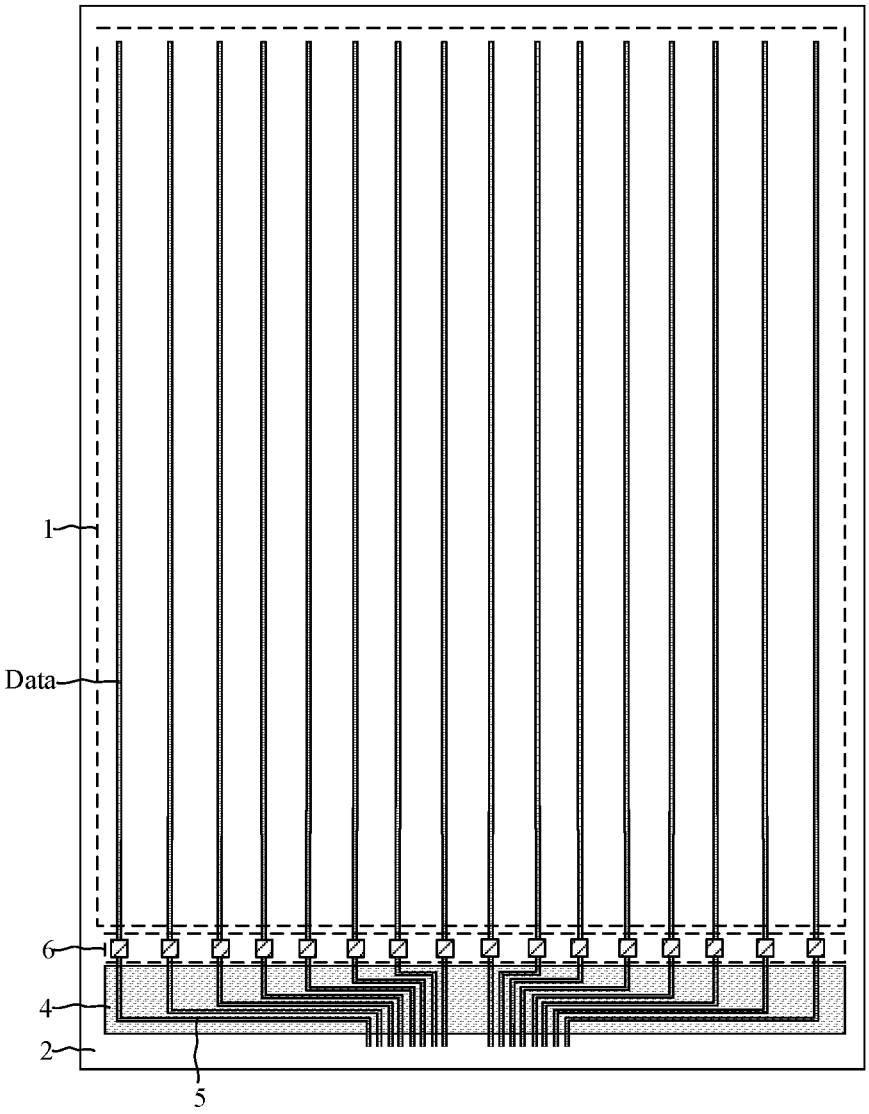
FIG. 2 is a schematic structural diagram of a display panel according to an embodiment of the present disclosure.

FIG. 2 is a schematic structural diagram of a display panel according to an embodiment of the present disclosure. As shown in FIG. 2, the display panel has a display region 1 and a non-display region 2 surrounding the display region 1.

Figure 3:
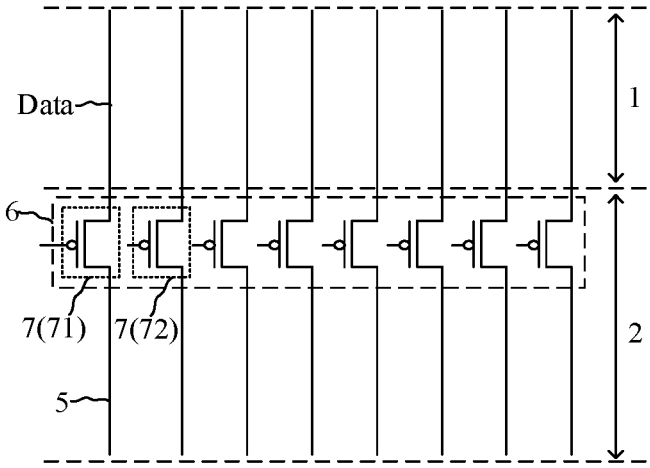
FIG. 3 is a schematic diagram of a circuit structure of a control circuit according to an embodiment of the present disclosure.
Figure 4:
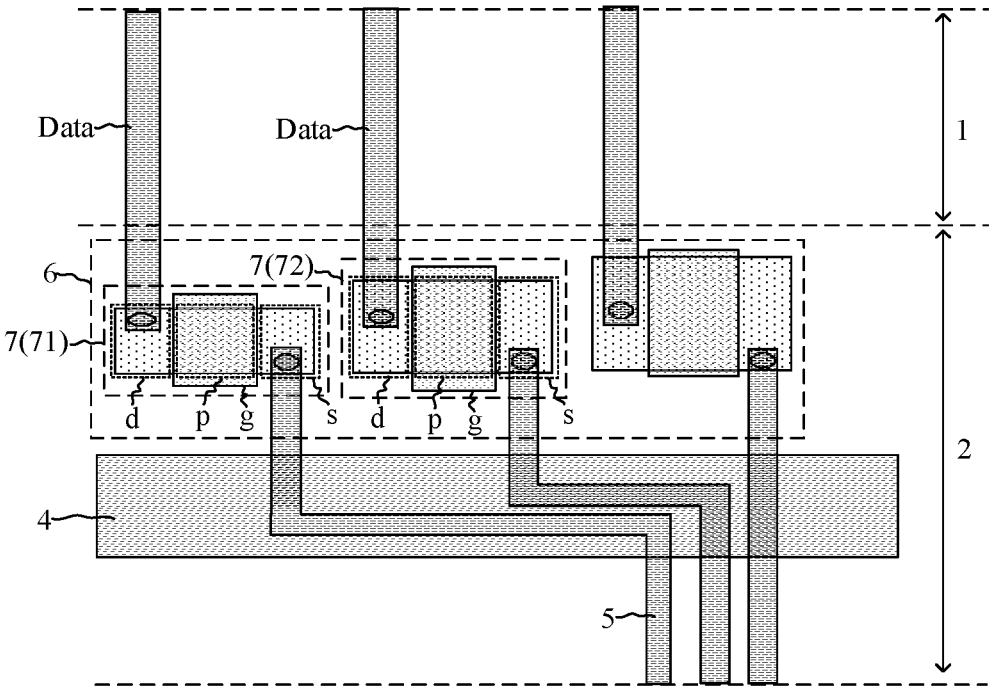
FIG. 4 is a schematic diagram of a film structure of a control circuit according to an embodiment of the present disclosure.

The display panel further includes data lines Data located in the display region 1, a power bus 4 located in the non-display region 2, connection traces 5 located in the non-display region 2, and a control circuit 6 located in the non-display region 2. The data lines Data are electrically connected to pixels in the display region 1 and configured to transmit voltage signals to pixel circuits, so as to control the pixel circuits to drive light-emitting elements to emit light. The power bus 4 is electrically connected to a power signal terminal in the non-display region 2 and a power signal line in the display region 1 and is configured to transmit, to the power signal line, a power signal provided by the power signal terminal. The connection traces 5 are coupled to the data lines Data. In a direction perpendicular to a plane of the display panel, the connection trace 5 at least partially overlaps with the power bus 4, and has a first area that is an overlapping area between the connection trace 5 and the power bus 4. FIG. 3 is a schematic diagram of a circuit structure of a control circuit according to an embodiment of the present disclosure, and FIG. 4 is a schematic diagram of a film structure of a control circuit according to an embodiment of the present disclosure. As shown in FIG. 3 and FIG. 4, the control circuit 6 includes control transistors 7, and a first electrode and/or a second electrode of the control transistor 7 is coupled to the connection traces 5.

The control transistors 7 include a first control transistor 71 and a second control transistor 72, the first area of the connection trace 5 coupled to the first control transistor 71 is different from the first area of the connection trace 5 coupled to the second control transistor 72, and a channel area of the first control transistor 71 is different from a channel area of the second control transistor 72.

Referring to FIG. 4, the control transistor 7 includes a gate g, a first electrode s, a second electrode d, and a channel p. The channel p is located between the first electrode s and the second electrode d, and in the direction perpendicular to the plane of the display panel, the gate g covers the channel p. When the gate g receives a turn-on voltage, the first electrode s and the second electrode d are electrically connected to each other through the channel p, thereby forming a signal transmission path between the first electrode s and the second electrode d. In the embodiments of the present disclosure, the channel area refers to an area of an orthographic projection of the channel p on the plane of the display panel in the direction perpendicular to the plane of the display panel.

When the data line Data is coupled to the control transistor 7, the voltage signal transmitted on the data line Data will be affected by the parasitic capacitance of the control transistor 7. For example, the control transistor 7 switches between on and off states (turn-on/cut-off), the gate potential of the control transistor 7 jumps; and under the coupling effect of the parasitic capacitance of the control transistor 7, the potential on the first electrode and/or the second electrode of the control transistor 7 fluctuates, thus affecting the voltage signal transmitted on the data line Data.

In some embodiments of the present disclosure, for the first control transistor 71 and the second control transistor 72, when the connection traces 5 respectively coupled to the two control transistors 7 have different first areas, the two connection traces 5 have different loads, and voltage signals have different voltage variations when transmitted on the two connection traces 5. In this case, the first control transistor 71 and the second control transistor 72 can have different channel areas, so that gates covering channels of the two control transistors 7 have different sizes, and therefore parasitic capacitances between the two control transistors 7 and the connection traces 5 are different.

With such configuration, the variation difference of the voltage signals caused by the different parasitic capacitances of the two control transistors 7 can be used to compensate the variation difference of the voltage signals caused by the different loads of the two connection traces 5, so that the voltage signals transmitted to the two data lines Data coupled to the first control transistor 71 and the second control transistor 72 tend to be consistent, thereby improving the homogeneity of voltage signals in the data lines Data.

During a screen lighting test for the display panel, homogeneity of test voltage signals inputted on different data lines Data can be improved, to avoid display non-uniformity or a Moore phenomenon of a test image, thereby improving the reliability of product evaluation.

It can be understood that the first control transistor 71 and the second control transistor 72 are not intended to specifically limit two particular control transistors 7. For any two control transistors 7, when the channel areas of the two control transistors 7 and the connection traces 5 coupled thereto meet the foregoing condition, one of the connection traces can be regarded as the first control transistor 71, and the other one of the connection traces can be regarded as the second control transistor 72.

In an implementation, the channel area of the first control transistor 71 is $S_{C1}$, and the first area of the connection trace 5 coupled to the first control transistor 71 is $S_{O1}$, the channel area of the second control transistor 72 is $S_{C2}$, and the first area of the connection trace 5 coupled to the second control transistor 72 is Sot, $S_{O1}>S_{O2}$, and $S_{C1}<S_{C2}$.

An overlapping area between the connection trace 5 coupled to the first control transistor 71 and the power bus 4 is greater than an overlapping area between the connection trace 5 coupled to the second control transistor 72 and the power bus 4. Therefore, the connection trace 5 coupled to the first control transistor 71 has a higher load, and the voltage signal has a higher degree of attenuation when transmitted on the connection trace 5. In this case, the parasitic capacitance of the first control transistor 71 and the parasitic capacitance between the first control transistor 71 and the connection trace 5 by reducing the channel area $S_{C1}$ of the first control transistor 71. When the gate potential of the first control transistor 71 jumps, voltage fluctuations on the first electrode and the second electrode of the first control transistor 71 can be reduced, thereby reducing the impact on the voltage signal transmitted to the data line Data. Therefore, compared with the second control transistor 72, the decrease in the voltage signal caused by the parasitic capacitance of the first control transistor 71 can compensate the increase in the voltage signal caused by the load of the coupled connection trace 5, so that the voltage signals transmitted on the two data lines Data coupled to the first control transistor 71 and the second control transistor 72 tend to be consistent.

Figure 5:
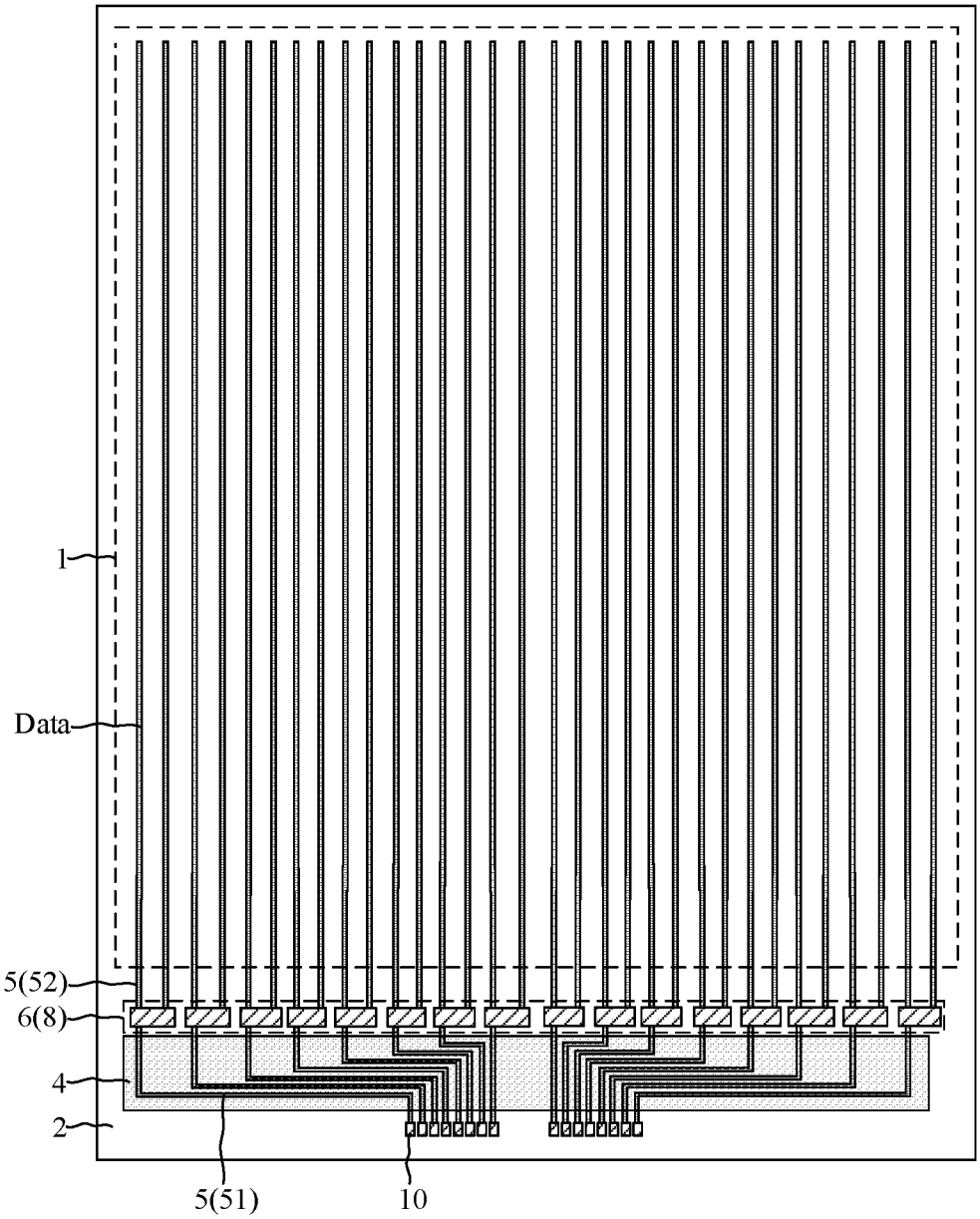
FIG. 5 is a schematic structural diagram of a display panel of a control circuit according to an embodiment of the present disclosure.
Figure 6:
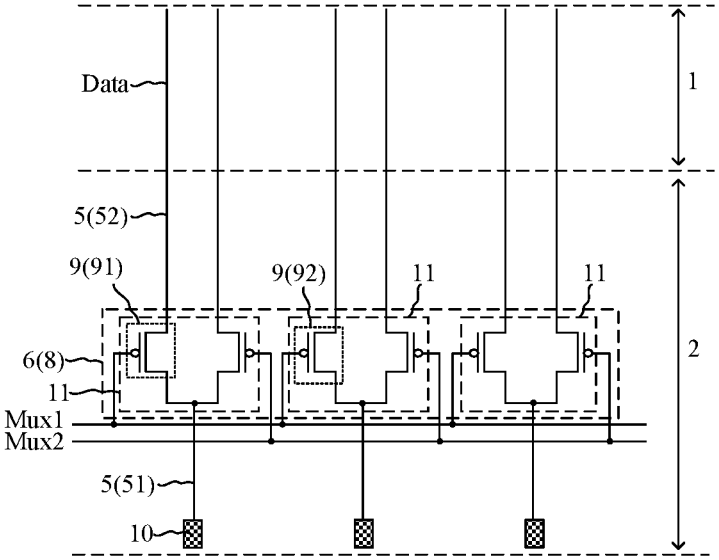
FIG. 6 is a schematic diagram of a circuit structure of a control circuit according to an embodiment of the present disclosure.
Figure 7:
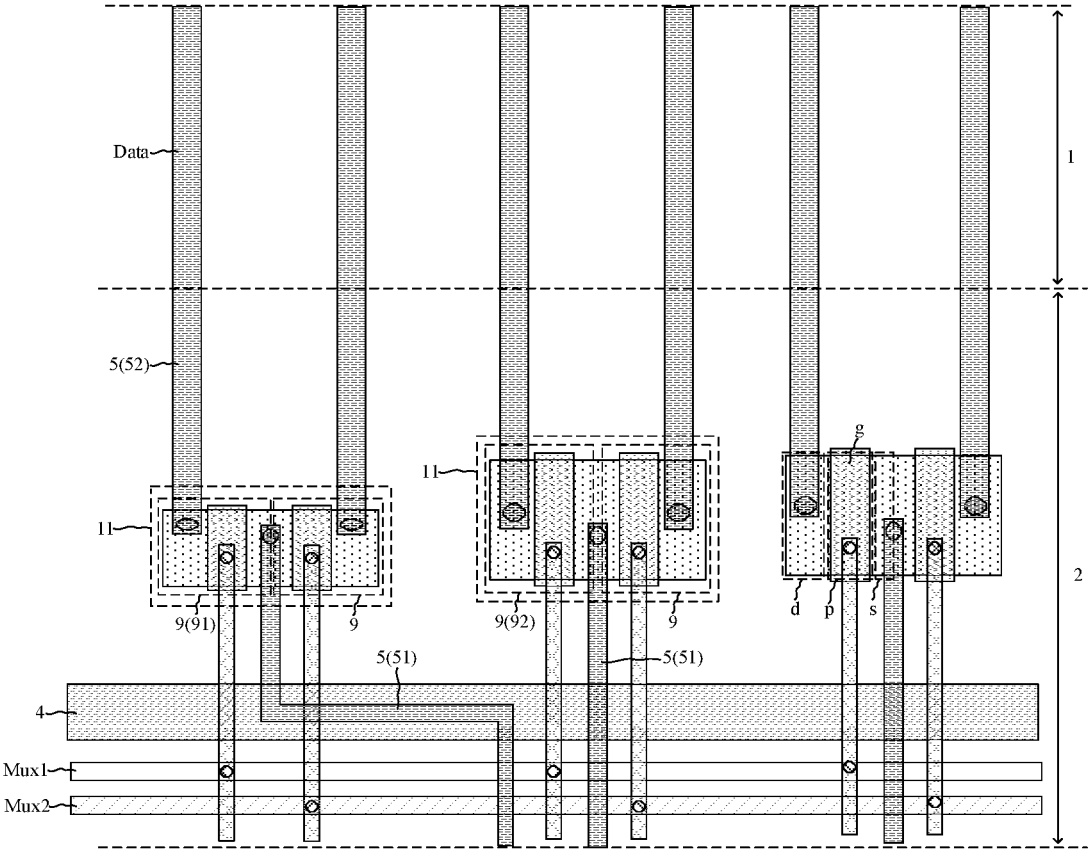
FIG. 7 is a schematic diagram of a film structure of a control circuit according to an embodiment of the present disclosure.

FIG. 5 is a schematic structural diagram of a display panel of a control circuit according to an embodiment of the present disclosure; FIG. 6 is a schematic diagram of a circuit structure of a control circuit according to an embodiment of the present disclosure; FIG. 7 is a schematic diagram of a film structure of a control circuit according to an embodiment of the present disclosure. In an implementation, as shown in FIG. 5 to FIG. 7, the connection trace 5 includes a first connection sub-trace 51 and a second connection sub-trace 52. The control circuit 6 includes a gating circuit 8, and the gating circuit 8 includes gating transistors 9. First electrodes of the gating transistors 9 are coupled to data signal transmission terminals 10 through the first connection sub-traces 51, and second electrodes of the gating transistors 9 are coupled to the data lines Data through the second connection sub-traces 52. In the direction perpendicular to the plane of the display panel, the first connection sub-trace 51 overlaps with the power bus 4. That is, the gating transistor 9 is located at a side of the power bus 4 close to the display region 1.

The gating transistors 9 include first gating transistors 91 and second gating transistors 92. The first connection sub-trace 51 coupled to the first gating transistor 91 and the first connection sub-trace 51 coupled to the second gating transistor 92 have different first areas, and the first gating transistor 91 and the second gating transistor 92 have different channel areas.

Referring to FIG. 6, the gating circuit 8 can include gating units 11, and the gating units 11 include gating transistors 9. Gates of i-th gating transistors 9 of multiple gating units 11 are electrically connected to a same gating control signal line Mux (two gating control signal lines in FIG. 6 and FIG. 7 are denoted by Mux1 and Mux2, respectively). First electrodes of the gating transistors 9 of the gating unit 11 are electrically connected to the data signal transmission terminal 10 through the first connection sub-trace 51, and second electrodes of the gating transistors 9 of the gating unit 11 are electrically connected to data lines Data through second connection sub-traces 52 in a one-to-one correspondence.

The gating circuit 8 is configured to control gating transistors 9 of a same gating unit 11 to be turned on, thereby controlling the voltage signal provided by the data signal transmission terminal 10 to be transmitted, through the first connection trace 5 in a time division manner, to the data lines Data electrically connected to multiple gating transistors 9. Based on the time division driving manner, only a small number of first connection sub-traces 51 and data signal transmission terminals 10 can be provided in the display panel, thereby facilitating the narrow bezel design of the display panel.

When the first connection sub-trace 51 coupled to the first gating transistor 91 and the first connection sub-traces 51 coupled to the second gating transistor 92 have different first areas, by designing the channel areas of the gating transistors 9 to be different, the parasitic capacitances of the two gating transistors 9 can be adjusted, so that the parasitic capacitance of the two gating transistors 9 are different from each other. In this case, the difference between variations of the voltage signals caused by the different parasitic capacitances of the two gating transistors 9 can be used to compensate the difference between variations of the voltage signals caused by the different loads of the two first connection sub-traces 51, so that the voltage signals transmitted to the two data lines Data coupled to the first gating transistor 91 and the second gating transistor 92 tend to be the same, thereby improving the homogeneity of voltage signals transmitted on different data lines Data.

Figure 8:
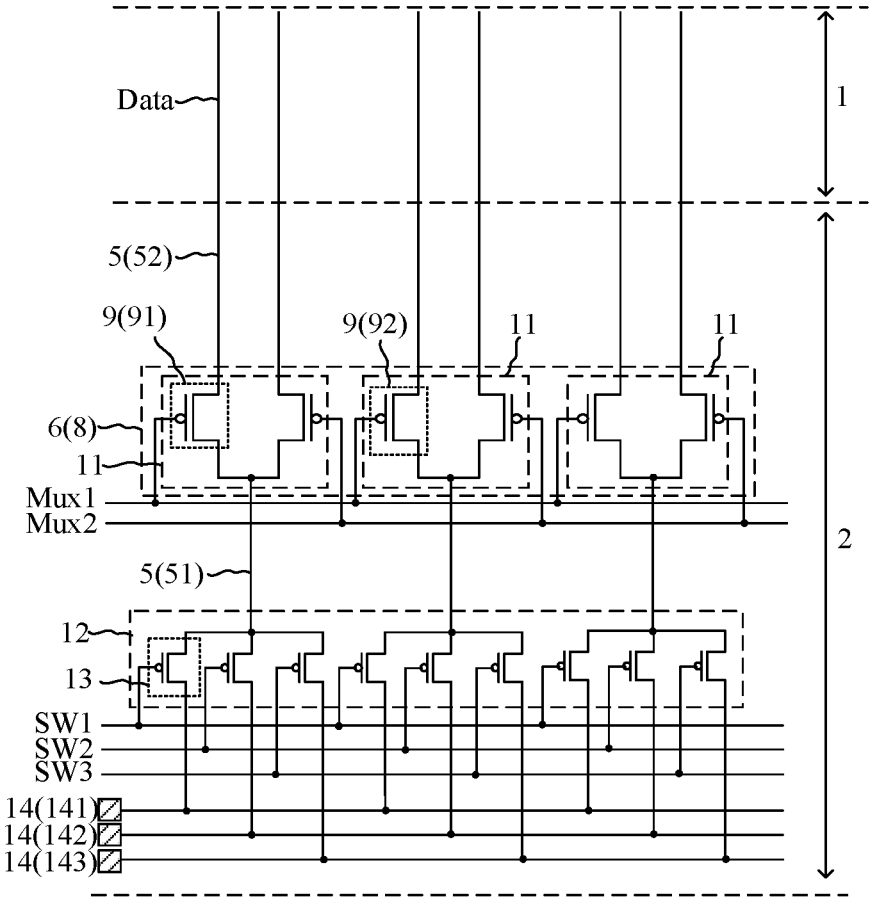
FIG. 8 is a schematic structural diagram of a first test circuit according to an embodiment of the present disclosure.

FIG. 8 is a schematic structural diagram of a first test circuit according to an embodiment of the present disclosure. As shown in FIG. 8, the display panel can further includes a first test circuit 12, and the first test circuit 12 includes a first-type test transistor 13. The first-type test transistor 13 is coupled to the first connection sub-trace 51, and the first-type test transistor 13 is further coupled to a test pin 14 and/or a test control switch signal line SW.

The first test circuit 12 is configured to perform a screen lighting test on the display panel before the display panel leaves the factory. The test pin 14 can include a first test pin 141 configured to provide a red test voltage signal, a second test pin 142 configured to provide a green test voltage signal, and a third test pin 143 configured to provide a blue test voltage signal.

Figure 9:
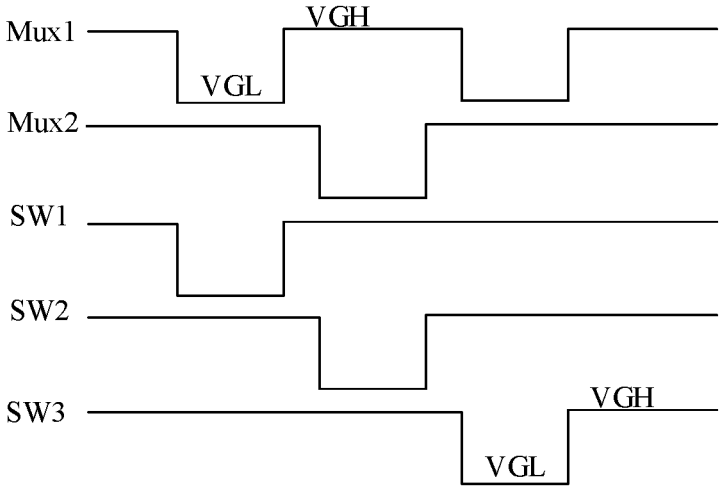
FIG. 9 is a diagram of a signal sequence according to an embodiment of the present disclosure.

During the screen lighting test, with reference to the signal sequence diagram shown in FIG. 9, when a red image is tested, the test control switch signal line SW controls the first-type test transistor 13 electrically connected to the first test pin 141 to be turned on, so that a path between the first test pin 141 and the first connection trace 5 is turned on; meanwhile, the gating control signal line Mux controls at least one gating transistor 9 to be turned on, so as to turn on a path between the data line Data coupled to a red sub-pixel and the first connection trace 5, thereby forming a signal transmission path between the first test pin 141 and the data line Data coupled to the red sub-pixel, so that the red test voltage signal is transmitted to the data line Data through the first-type test transistor 13, the first connection trace 5, the gating transistor 9, and the second connection trace 5.

When a green image is tested, the test control switch signal line SW controls the first-type test transistor 13 electrically connected to the second test pin 142 to be turned on, so that a path between the second test pin 142 and the first connection trace 5 is turned on; meanwhile, the gating control signal line Mux controls at least one gating transistor 9 to be turned on, so as to turn on a path between the data line Data coupled to a green sub-pixel and the first connection trace 5, thereby forming a signal transmission path between the second test pin 142 and the data line Data coupled to the green sub-pixel, so that the green test voltage signal is transmitted to the data line Data through the first-type test transistor 13, the first connection trace 5, the gating transistor 9, and the second connection trace 5.

When a blue image is tested, the test control switch signal line SW controls the first-type test transistor 13 electrically connected to the third test pin 143 to be turned on, so that a path between the third test pin 143 and the first connection trace 5 is turned on; meanwhile, the gating control signal line Mux controls at least one gating transistor 9 to be turned on, so as to turn on a path between the data line Data connected to a blue sub-pixel and the first connection trace 5, thereby forming a signal transmission path between the third test pin 143 and the data line Data coupled to the blue sub-pixel, so that the blue test voltage signal is transmitted to the data line Data through the first-type test transistor 13, the first connection trace 5, the gating transistor 9, and the second connection trace 5.

After the screen lighting test for the display panel is finished, to avoid the test pin 14 or the test control switch signal line SW from occupying the bezel width in the display panel, the test pin 14 or the test control switch signal line SW can be cut out from a motherboard of the display panel, so that the test pin 14 or the test control switch signal line SW is not retained in the display panel.

The test pin 14 being cut out corresponds to the foregoing case where the first-type test transistor 13 is further coupled to the test control switch signal line SW, the test control switch signal line SW being cut out corresponds to the foregoing case where the first-type test transistor 13 is further coupled to the test pin 14, and neither the test control switch signal line SW nor the test pin 14 being cut out corresponds to the foregoing case where the first-type test transistor 13 is further coupled to the test pin 14 and the test control switch signal line SW.

In an implementation, the channel area of the first gating transistor 91 is $S_{C11}$, the channel area of the second gating transistor 92 is $S_{C12}$, and $S_{C11}-S_{C12}$ satisfies the following relationship:

$$S_{C11} - S_{C_{12}} = -(C_{11} - C_{12}) \times \frac{W_s \times L_s \times (C_2 + C_{Data})}{(C_{11} + C_2 + D_{Data})^2},$$

where $C_{11}$ denotes a parasitic capacitance of the first connection sub-trace 51 coupled to the first gating transistor 91, $C_{12}$ denotes a parasitic capacitance of the first connection sub-trace 51 coupled to the second gating transistor 92, $W_s$ denotes a channel width of the first-type test transistor 13, $L_s$ denotes a channel length of the first-type test transistor 13, $C_2$ denotes a parasitic capacitance of the second connection sub-trace 52, and $C_{Data}$ denotes a parasitic capacitance of the data line Data.

With reference to the analysis on the foregoing screen lighting test process, during the screen lighting test, the turn-on status of the first-type test transistor 13 and the gating transistor 9 can be controlled, to ensure that the test voltage signal can be transmitted to the data line Data through the test signal terminal. When the turn-on status of the first-type test transistor 13 and the gating transistor 9 is switched, the gate potential of the first-type test transistor 13 and the gate potential of the gating transistor 9 jump, and under the effect of the parasitic capacitances of the transistors, the gate potential jump affects the test voltage signal transmitted on the data line Data.

Figure 10:
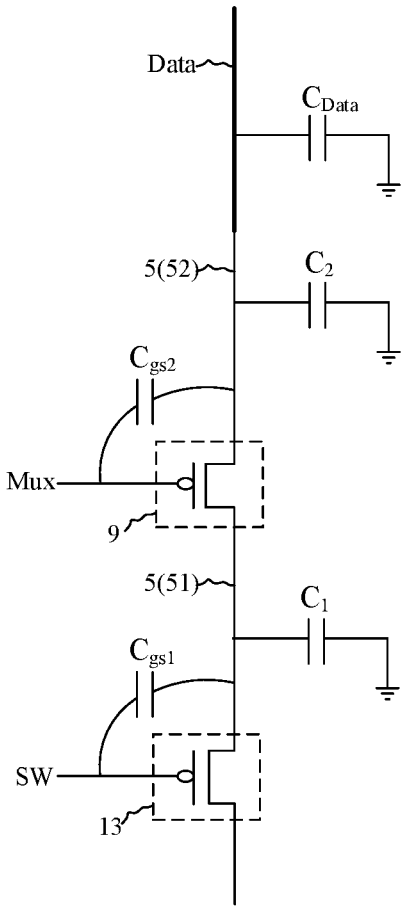
FIG. 10 is an equivalent schematic structural diagram of parasitic capacitances of transistors and signal lines according to an embodiment of the present disclosure.

FIG. 10 is an equivalent schematic structural diagram of parasitic capacitances of transistors and signal lines according to an embodiment of the present disclosure. As shown in FIG. 10, when the first-type test transistor 13 is turned off, the voltage variation on the data line Data is ΔV1, and $$\Delta V1 = \frac{(VGH - VGL)_x Cgs1}{C_1 + C_2 + C_{Data}}, 1$$

where VGH denotes a cut-off voltage of the transistor (the first-type test transistor 13 and the gating transistor 9), VGL denotes a turn-on voltage of the transistor (the first-type test transistor 13 and the gating transistor 9), $C_1$ is a parasitic capacitance of the first connection sub-trace 51, and Cgs1 denotes a parasitic capacitance of the first-type test transistor 13. When the gating transistor 9 is turned off, the voltage variation on the data line Data is ΔV2, $$\Delta V2 = \frac{(VGH - VGL)_x Cgs2}{C_2 + C_{Data}},$$

where Cgs2 denotes a parasitic capacitance of the gating transistor 9.

The impact caused by the parasitic capacitance $C_1$ of the first connection sub-trace 51 to the voltage variation of the data line Data can be obtained by taking partial differential of ΔV1:

$$\frac{\partial(\Delta V1)}{\partial(C_1)} = -\frac{(VGH - VGL) \times Cgs1}{(C_1 + C_2 + C_{Data})^2}.$$

The impact caused by the parasitic capacitance Cgs2 of the gating transistor 9 to the voltage variation on the data line Data can be obtained by taking partial differential of ΔV2:

$$\frac{\partial(\Delta V2)}{\partial(Cgs2)} = \frac{VGH - VGL}{C_2 + C_{Data}}.$$

For the first gating transistor 91 and the second gating transistor 92, the difference between the parasitic capacitance $C_{11}$ of the first connection sub-trace 51 coupled to the first gating transistor 91 and the parasitic capacitance $C_{12}$ of the first connection sub-trace 51 coupled to the second gating transistor 92 is $\Delta C_1$, where $\Delta C_1 = C_{11} - C_{12}$, and the difference between the parasitic capacitances of the first gating transistor 91 and the second gating transistor 92 is ΔCgs2, where ΔCgs2=ΔCgs21−ΔCgs22.

The impact caused by the capacitance difference $\Delta C_1$ to the voltage variation on the data line Data is $$\Delta C_1 \times \frac{\partial(\Delta V1)}{\partial(C_1)},$$

that is, $$-\Delta C_1 \times \frac{(VGH - VGL) \times Cgs1}{(C_1 + C_2 + C_{Data})^2}.$$

The impact caused by the capacitance difference ΔCgs2 to the voltage variation on the data line Data is $$\Delta Cgs2 \times \frac{\partial(\Delta V2)}{\partial(Cgs2)},$$

that is, $$\Delta Cgs2 \times \frac{VGH - VGL}{C_2 + C_{Data}}.$$

In this case, values of $$\Delta C_1 \times \frac{\partial(\Delta V1)}{\partial(C_1)} \text{ and } \Delta Cgs2 \times \frac{\partial(\Delta V2)}{\partial(Cgs2)}$$

can be set to be equal to each other, so that the impacts caused by the two capacitance differences to the voltage variation on the data line Data offset each other, thereby making voltage signals transmitted on different data lines Data tend to be consistent.

According to $$\Delta C_1 \times \frac{\partial(\Delta V1)}{\partial(C_1)} = \Delta Cgs2 \times \frac{\partial(\Delta V2)}{\partial(Cgs2)},$$

it can be obtained that:

$$-\frac{\Delta C_1 \times Cgs1}{(C_1 + C_2 + C_{Data})^2} = \frac{\Delta Cgs2}{C_2 + C_{Data}} \cdot Cgs1 = k \times W_s \times L_s,$$

$$\Delta Cgs2 = k \times (S_{C11} - S_{C12}),$$

and k is a process parameter value, where k is a constant, and the value of k is related to factors such as a film thickness and a dielectric constant of the transistor. Because the gating transistor 9 and the first-type test transistor 13 are formed by using a same composition process, the values of k in the two formulas are the same. In this case, it is further obtained that:

$$-\frac{\Delta C_1 \times W_s \times L_s}{(C_1 + C_2 + C_{Data})^2} = \frac{S_{C11} - S_{C12}}{C_2 + C_{Data}},$$

thereby obtaining $$S_{C11} - S_{C12} = -(C_{11} - C_{12}) \times \frac{W_s \times L_s \times (C_2 + C_{Data})}{(C_{11} + C_2 + C_{Data})^2}.$$

In conclusion, by making the difference between the channel areas of the first gating transistor 91 and the second gating transistor 92 satisfy the following relationship:

$$S_{C11} - S_{C12} = -(C_{11} - C_{12}) \times \frac{W_s \times L_s \times (C_2 + C_{Data})}{(C_{11} + C_2 + C_{Data})^2},$$

the impact caused by the capacitance difference ΔCgs2 to the voltage variation on the data line Data can offset the impact caused by the capacitance difference $\Delta C_1$ to the voltage variation on the data line Data, so that the voltage signals on the data lines Data coupled to the first gating transistor 91 and the second gating transistor 92 tend to be the same.

Figure 11:
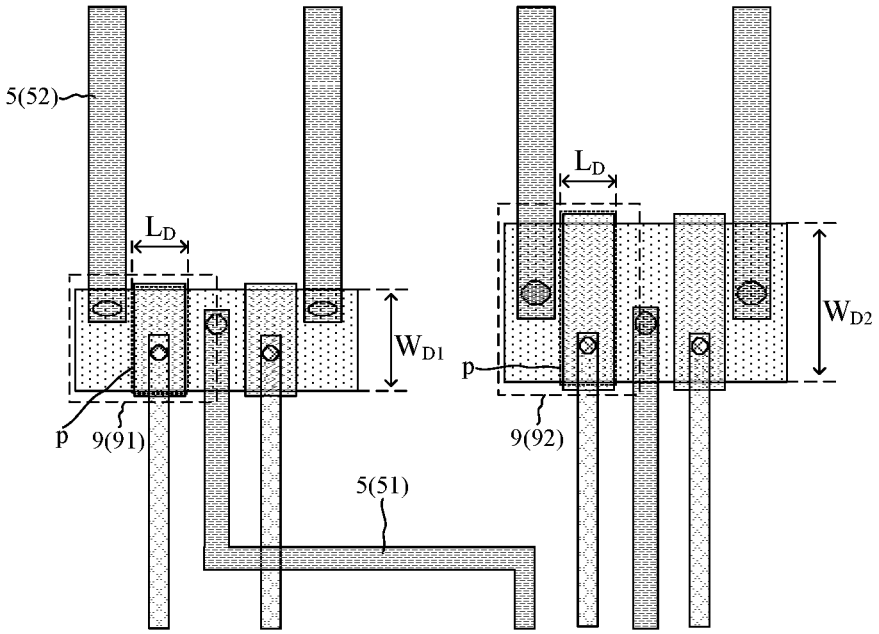
FIG. 11 is a schematic diagram of channel comparison between a first gating transistor and a second gating transistor according to an embodiment of the present disclosure.

FIG. 11 is a schematic diagram of channel comparison between a first gating transistor and a second gating transistor according to an embodiment of the present disclosure. As shown in FIG. 11, during channel size design of the gating transistors 9, the channel lengths $L_D$ of the gating transistors 9 can be the same, and only the channel widths of the first gating transistor 91 and the second gating transistor 92 are designed to be different from each other.

In this case, the channel width of the first gating transistor 91 is $W_{D1}$, the channel width of the second gating transistor 92 is $W_{D2}$, and the difference between $W_{D1}$ and $W_{D2}$ satisfies the following relationship:

$$W_{D1} - W_{D2} = -(C_{11} - C_{12}) \times \frac{W_s \times L_s \times (C_2 + C_{Data})}{(C_{11} + C_2 + C_{Data})^2 \times L_D},$$

so that the impact caused by the capacitance difference ΔCgs2 to the voltage variation on the data line Data can compensate the impact caused by the capacitance difference $\Delta C_1$ to the voltage variation on the data line Data.

Figure 12:
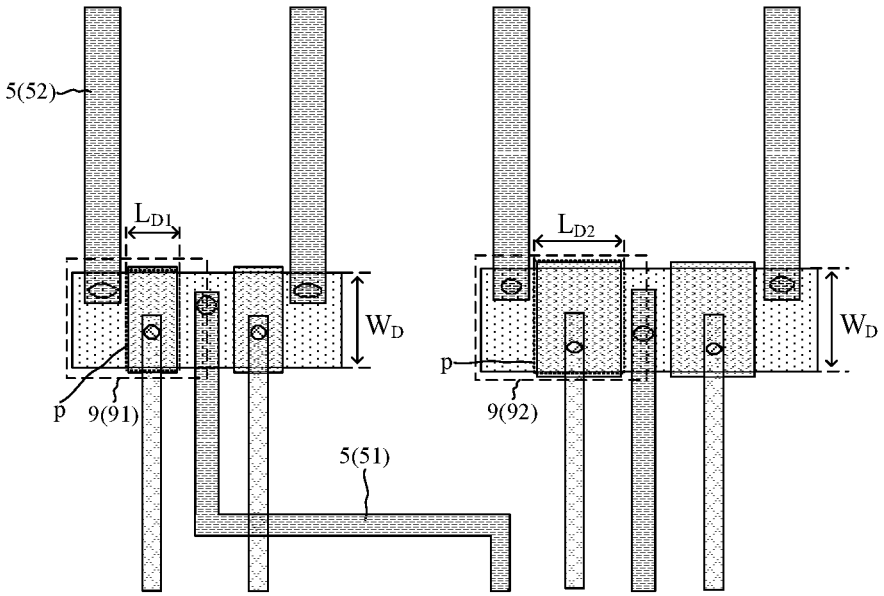
FIG. 12 is a schematic diagram of channel comparison between a first gating transistor and a second gating transistor according to an embodiment of the present disclosure.

FIG. 12 is a schematic diagram of a channel comparison between a first gating transistor and a second gating transistor according to an embodiment of the present disclosure; as shown in FIG. 12, during channel size design of the gating transistors 9, the channel widths $W_D$ of the gating transistors 9 can be the same, and only the channel lengths of the first gating transistor 91 and the second gating transistor 92 are designed to be different from each other.

In this case, the channel length of the first gating transistor 91 is $L_{D1}$, the channel length of the second gating transistor 92 is $L_{D2}$, and the difference between $L_{D1}$ and $L_{D2}$ satisfies the following relationship:

$$L_{D1} - L_{D2} = -(C_{11} - C_{12}) \times \frac{W_s \times L_s \times (C_2 + C_{Data})}{(C_{11} + C_2 + C_{Data})^2 \times W_D},$$

so that the impact caused by the capacitance difference ΔCgs2 to the voltage variation on the data line Data can compensate the impact caused by the capacitance difference $\Delta C_1$ to the voltage variation on the data line Data.

It can be understood that, in other embodiments of the present disclosure, the channel lengths and the channel widths of the first gating transistor 91 and the second gating transistor 92 can be adjusted at the same time, so as to design the channel areas of the first gating transistor 91 and the second gating transistor 92 to be different from each other.

Figure 13:
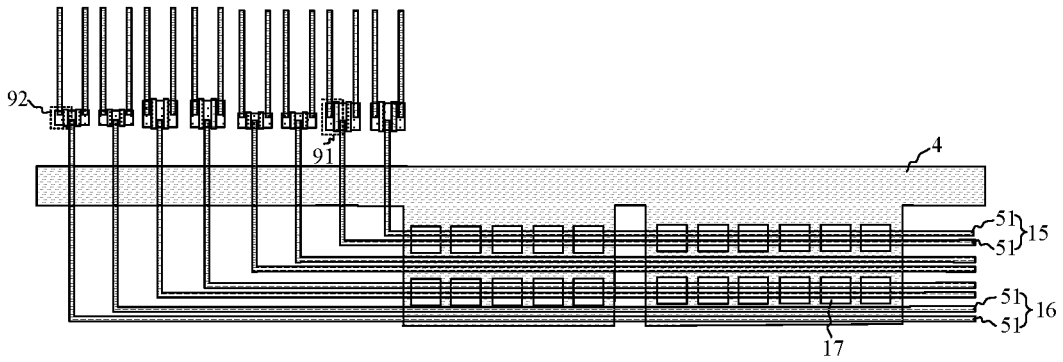
FIG. 13 is a schematic structural diagram of a first trace group and a second trace group according to an embodiment of the present disclosure.

FIG. 13 is a schematic structural diagram of a first trace group and a second trace group according to an embodiment of the present disclosure. In an implementation, as shown in FIG. 13, the display panel includes a first trace group 15 and a second trace group 16. The first trace group 15 and the second trace group 16 each include multiple first connection sub-traces 51. The first gating transistor 91 is the gating transistor 9 coupled to the first connection sub-trace 51 in the first trace group 15, and the second gating transistor 92 is the gating transistor 9 coupled to the first connection sub-trace 51 in the second trace group 16.

The channel area of the first gating transistor 91 is $S_{C11}'$, the channel area of the second gating transistor 92 is $S_{C12}'$, and $$S'_{C11} - S'_{C12} = -(C'_{11} - C'_{12}) \times \frac{W_s \times L_s \times (C_2 + C_{Data})}{(C'_{11} + C_2 + C_{Data})^2}.$$

The derivation process of the formula is similar to the derivation process in the foregoing embodiment, and details are not repeated herein. $C_{11}'$ denotes an average value of parasitic capacitances of the first connection sub-traces 51 in the first trace group 15, $C_{12}'$ denotes an average value of parasitic capacitances of the first connection sub-traces 51 in the second trace group 16, $W_s$ denotes a channel width of the first-type test transistor 13, $L_s$ denotes a channel length of the first-type test transistor 13, $C_2$ denotes a parasitic capacitance of the second connection sub-trace 52, and $C_{Data}$ denotes a parasitic capacitance of the data line Data.

With the foregoing configuration, the first connection sub-traces 51 are classified into different groups, and only the channel areas of the gating transistors 9 coupled to different trace groups are designed to be different, while the channel areas of the gating transistors 9 coupled to the same trace group are designed to be the same, so that the design difficulty of the transistors can be reduced while the homogeneity of voltage signals transmitted on different data lines Data is improved.

Referring to FIG. 13, the power bus 4 includes hollowed-out regions 17. In the direction perpendicular to the plane of the display panel, the first connection sub-trace 51 in the first trace group 15 at least partially overlaps with at least one hollowed-out region 17, and the first connection sub-traces 51 in the second trace group 16 do not overlap with the hollowed-out regions 17.

In the embodiments of the present disclosure, hollowed-out regions 17 can be arranged on the power bus 4 to reduce the load of the power bus 4. After the hollowed-out regions 17 are arranged on the power bus 4, at least one first connection sub-trace 51 overlaps with the hollowed-out region 17, and at least one first connection sub-trace 51 does not overlap with the hollowed-out regions 17. For the first connection sub-trace 51 overlapping with the hollowed-out region 17, the first connection sub-trace 51 have a relatively small overlapping areas with the power signal line. Therefore, the first connection sub-traces 51 has a relatively low load, and the voltage signal have a low degree of attenuation when transmitted on the first connection sub-trace 51. For the first connection sub-traces 51 not overlapping with the hollowed-out regions 17, the first connection sub-trace 51 has a relatively large overlapping area with the power signal line. Therefore, the first connection sub-trace 51 has a relatively high load, and the voltage signal has a high degree of attenuation when transmitted on the first connection sub-trace 51.

The first connection sub-traces 51 in the first trace group 15 are all first connection sub-traces 51 overlapping with the hollowed-out regions 17, and the first connection sub-traces 51 in the second trace group 16 are all first connection sub-traces 51 not overlapping with the hollowed-out regions 17. On one hand, the first connection sub-traces 51 in the same trace group have similar loads, and when the gating transistors 9 coupled to the same trace group adopt the same channel area design, the load difference of the first connection sub-traces 51 in the trace group can still be compensated accurately. On the other hand, loads of first connection sub-traces 51 in different trace groups are significantly different, and by designing the channel areas of the gating transistors 9 coupled to different trace groups to be different, the load differences of different first connection sub-traces 51 with significantly different loads can be compensated accurately.

During channel size design of the gating transistors 9, the channel lengths $L_D'$ of the gating transistors 9 can be the same, and only the channel widths of the first gating transistor 91 and the second gating transistor 92 are designed to be different from each other. In this case, the channel width of the first gating transistor 91 is $W_{D1}'$, the channel width of the second gating transistor 92 is $W_{D2}'$, and the difference between $W_{D1}'$ and $W_{D2}'$ satisfies the following relationship:

$$W'_{D1} - W'_{D2} = -(C'_{11} - C'_{12}) \times \frac{W_s \times L_s \times (C_2 + C_{Data})}{(C'_{11} + C_2 + C_{Data})^2 \times L'_D},$$

so that the impact caused by the parasitic capacitance difference ΔCgs2' of the two gating transistors 9 to the voltage variation on the data line Data can compensate for the impact caused by the parasitic capacitance difference $\Delta C_1'$ of the first connection sub-traces 51 coupled to the two gating transistors 9 to the voltage variation on the data line Data.

In an embodiment, the channel widths $W_D'$ of the gating transistors 9 can be the same, and only the channel lengths of the first gating transistor 91 and the second gating transistor 92 are designed to be different from each other. In this case, the channel length of the first gating transistor 91 is $L_{D1}'$, the channel length of the second gating transistor 92 is $L_{D2}'$, and the difference between $L_{D1}'$ and $L_{D2}'$ satisfies the following relationship:

$$L_{D1}' - L_{D2}' = -(C_{11}' - C_{12}') \times \frac{W_s \times L_s \times (C_2 + C_{Data})}{(C_{11}' + C_2 + C_{Data})^2 \times W_D'},$$

so that the impact caused by the parasitic capacitance difference ΔCgs2' of the two gating transistors 9 to the voltage variation on the data line Data compensates for the impact caused by the parasitic capacitance difference $\Delta C_1'$ of the first connection sub-traces 51 coupled to the two gating transistors 9 to the voltage variation on the data line Data.

It can be understood that, in other embodiments of the present disclosure, the channel lengths and the channel widths of the first gating transistor 91 and the second gating transistor 92 can be adjusted at the same time, so as to design the channel areas of the first gating transistor 91 and the second gating transistor 92 to be different from each other.

Figure 14:
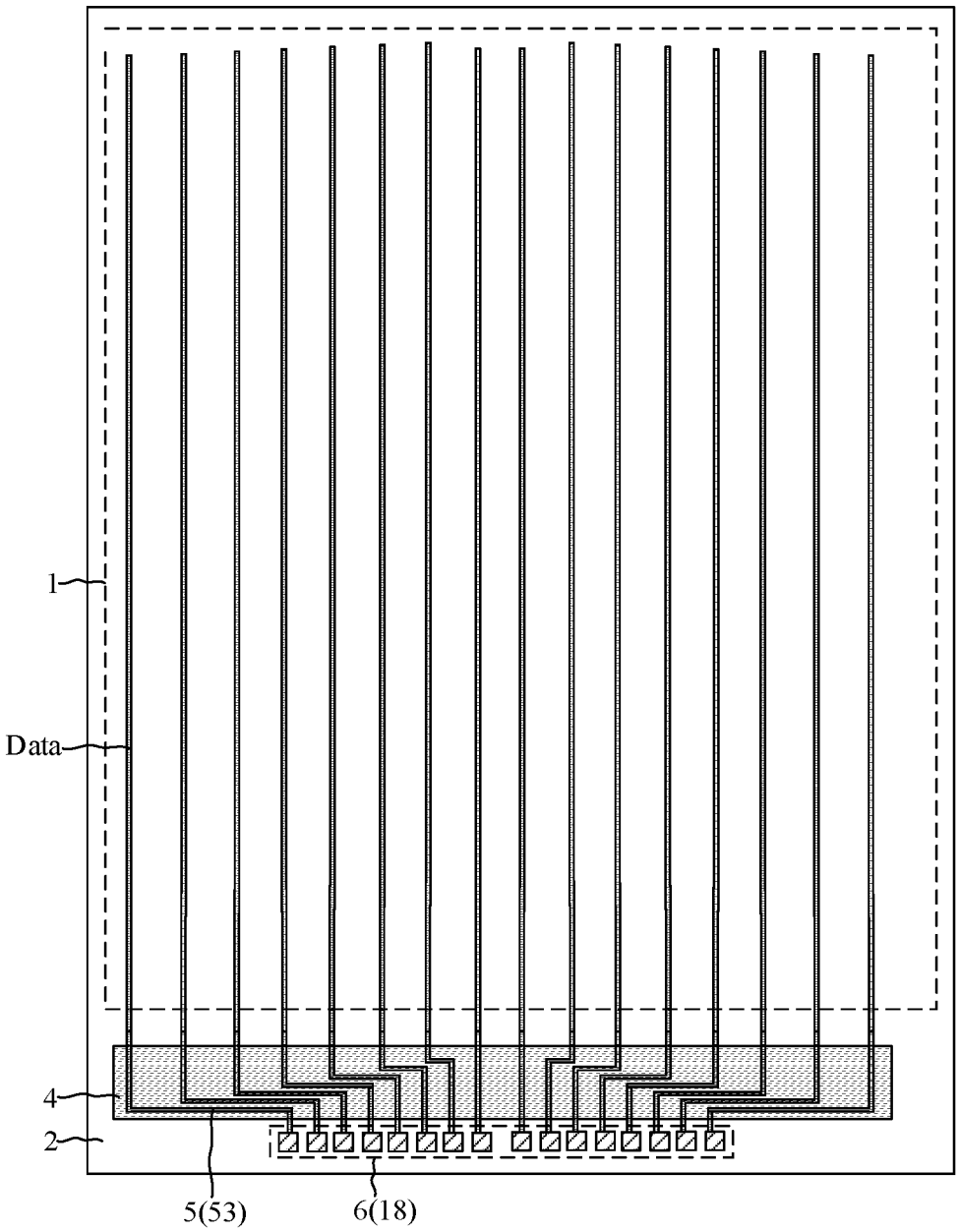
FIG. 14 is further a schematic structural diagram of a display panel according to an embodiment of the present disclosure.
Figure 15:
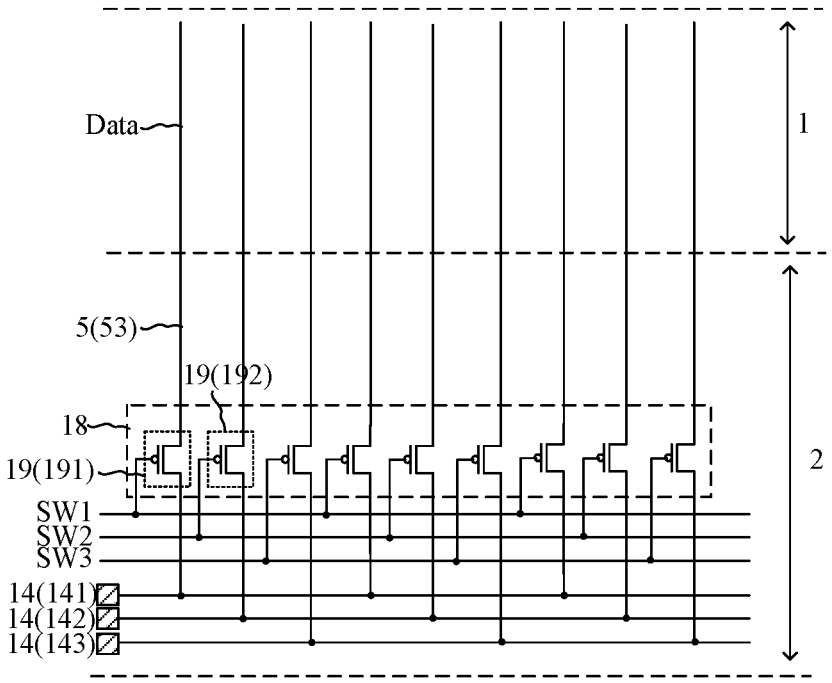
FIG. 15 is a schematic diagram of further a circuit structure of a control circuit according to an embodiment of the present disclosure.
Figure 16:
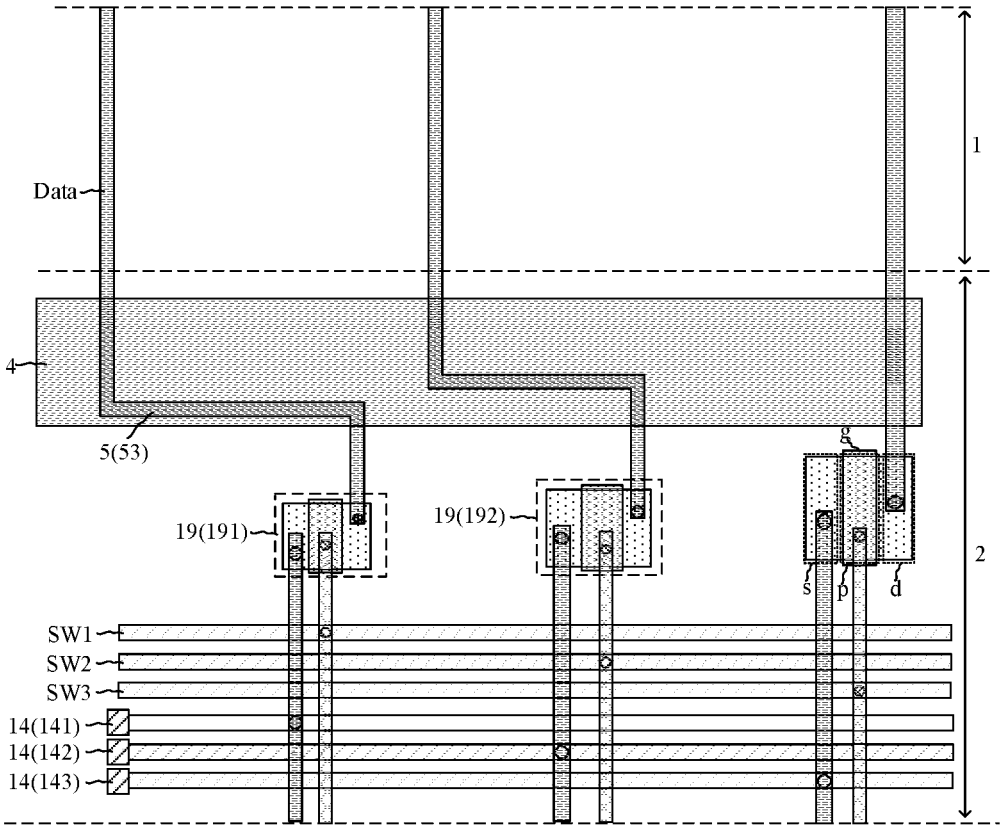
FIG. 16 is a schematic diagram of a film structure of a control circuit according to an embodiment of the present disclosure.

FIG. 14 is a schematic structural diagram of a display panel according to an embodiment of the present disclosure; FIG. 15 is a schematic diagram of a circuit structure of a control circuit according to an embodiment of the present disclosure; and FIG. 16 is a schematic diagram of a film structure of a control circuit according to an embodiment of the present disclosure. In an implementation, as shown in FIG. 14 to FIG. 16, the connection trace 5 includes a third connection sub-trace 53, the control circuit 6 includes a second test circuit 18, and the second test circuit 18 includes a second-type test transistor 19. A second electrode of the second-type test transistor 19 is coupled to the data line Data through the third connection sub-trace 53. In the direction perpendicular to the plane of the display panel, the third connection sub-trace 53 overlaps with the power bus 4.

Referring to FIG. 15 and FIG. 16, the test transistor can be coupled to the test pin 14 and/or the test control switch signal line SW.

The second-type test transistors 19 include a first test transistor 191 and a second test transistor 192, the third connection sub-trace 53 coupled to the first test transistor 191 and the third connection sub-trace 53 coupled to the second test transistor 192 have different first areas, and the first test transistor 191 and the second test transistor 192 have different channel areas.

The second test circuit 18 is configured to perform a screen lighting test on the display panel before the display panel leaves the factory. The test pin 14 can include a first test pin 141 configured to provide a red test voltage signal, a second test pin 142 configured to provide a green test voltage signal, and a third test pin 143 configured to provide a blue test voltage signal.

During the screen lighting test, when a red image is tested, the test control switch signal line SW controls the second-type test transistor 19 electrically connected to the first test pin 141 to be turned on, to turn on a transmission path between the first test pin 141 and the data line Data coupled to a red sub-pixel, so that the red test voltage signal is transmitted to the data line Data through the second-type test transistor 19 and the third connection trace 5.

When a green image is tested, the test control switch signal line SW controls the second-type test transistor 19 electrically connected to the second test pin 142 to be turned on, to turn on a transmission path between the second test pin 142 and the data line Data coupled to a green sub-pixel, so that the green test voltage signal is transmitted to the data line Data through the second-type test transistor 19 and the third connection trace 5.

When a blue image is tested, the test control switch signal line SW controls the second-type test transistor 19 electrically connected to the third test pin 143 to be turned on, to turn on a transmission path between the third test pin 143 and the data line Data coupled to a blue sub-pixel, so that the blue test voltage signal is transmitted to the data line Data through the second-type test transistor 19 and the third connection trace 5.

In the embodiments of the present disclosure, for the first test transistor 191 and the second test transistor 192, when the third connection traces 5 coupled to the two second-type test transistors 9 have different first areas, by designing the channel areas of the two second-type test transistors 9 to be different, the parasitic capacitances of the two second-type test transistors 9 can be different from each other. In this case, the difference between variations of the voltage signals caused by the different parasitic capacitances of the two second-type test transistors 9 can be used to compensate the difference between variations of the voltage signals caused by the different loads of the two third connection traces 5, so that the voltage signals transmitted to the two data lines Data coupled to the first test transistor 191 and the second test transistor 192 tend to be the same, thereby improving the homogeneity of voltage signals inputted to different data lines Data.

The channel area of the first test transistor 191 is $S_{C21}$, the channel area of the second test transistor 192 is $S_{C22}$, and $$S_{C21} - S_{C22} = -(C_{31} - C_{32}) \times \frac{S_{C21}}{C_{31} + C_{Data}},$$

where $C_{31}$ denotes a parasitic capacitance of the third connection sub-trace 53 coupled to the first test transistor 191, $C_{32}$ denotes a parasitic capacitance of the third connection sub-trace 53 coupled to the second test transistor 192, and $C_{Data}$ denotes a parasitic capacitance of the data line Data.

With reference to the analysis on the foregoing screen lighting test process, during the screen lighting test, the turn-on status of the second-type test transistor 19 can be controlled, to ensure that the test voltage signal can be transmitted to the data line Data through the test signal terminal. When the turn-on status of the second-type test transistor 19 is switched, the gate potential of the first-type test transistor 13 jumps, and under the effect of the parasitic capacitance of the transistor, the gate potential jump affects the test voltage signal transmitted on the data line Data.

Figure 17:
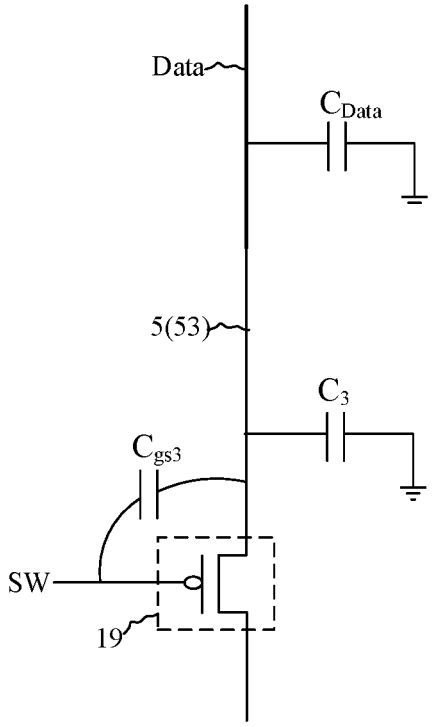
FIG. 17 is an equivalent schematic structural diagram of parasitic capacitances of transistors and signal lines according to an embodiment of the present disclosure.

FIG. 17 is an equivalent schematic structural diagram of parasitic capacitances of transistors and signal lines according to an embodiment of the present disclosure. As shown in FIG. 17, when the second-type test transistor 19 is turned off, the voltage variation on the data line Data is ΔV3, and $$\Delta V3 = \frac{(VGH - VGL) \times Cgs3}{C_3 + C_{Data}},$$

where VGH denotes a cut-off voltage of the transistor (the second-type test transistor 19), VGL denotes a turn-on voltage of the transistor (the second-type test transistor 19), $C_3$ denotes a parasitic capacitance of the third connection sub-trace 53, and Cgs3 denotes a parasitic capacitance of the second-type test transistor 19.

The impact caused by the parasitic capacitance $C_3$ of the third connection sub-trace 53 to the voltage variation of the data line Data can be obtained by taking partial differential of ΔV3:

$$\frac{\partial(\Delta V3)}{\partial(C_3)} = -\frac{(VGH - VGL) \times Cgs3}{(C_3 + C_{Data})^2}.$$

The impact caused by the parasitic capacitance Cgs3 of the second-type test transistor 19 to the voltage variation on the data line Data can be obtained by taking partial differential of ΔV3:

$$\frac{\partial(\Delta V3)}{\partial(Cgs3)} = \frac{VGH - VGL}{C_3 + C_{Data}}.$$

For the first test transistor 191 and the second test transistor 192, the difference between the parasitic capacitance $C_{31}$ of the third connection sub-trace 53 coupled to the first test transistor 191 and the parasitic capacitance $C_{32}$ of the third connection sub-trace 53 coupled to the second test transistor 192 is $\Delta C_3$, where $\Delta C_3 = C_{31} - C_{32}$. A difference between the parasitic capacitances of the first test transistor 191 and the second test transistor 192 is ΔCgs3, where ΔCgs3=ΔCgs31-ΔCgs32.

The impact caused by the capacitance difference $\Delta C_3$ to the voltage variation on the data line Data is $$\Delta C_3 \times \frac{\partial(\Delta V3)}{\partial(C_3)},$$

that is $$-\Delta C_3 \times \frac{(VGH - VGL) \times Cgs3}{(C_3 + C_{Data})^2}.$$

The impact caused by the capacitance difference ΔCgs3 to the voltage variation on the data line Data is $$\Delta Cgs3 \times \frac{\partial(\Delta V3)}{\partial(Cgs3)},$$

that is, $$\Delta Cgs3 \times \frac{VGH - VGL}{C_3 + C_{Data}}.$$

In this case, $$\Delta C_3 \times \frac{\partial(\Delta V3)}{\partial(C_3)}$$

and $$\Delta Cgs3 \times \frac{\partial(\Delta V3)}{\partial(Cgs3)}$$

can be equal to each other, so that the impacts caused by the two capacitance differences to the voltage variation on the data line Data offset each other, thereby making voltage signals transmitted on different data lines Data tend to be consistent.

According to $$\Delta C_3 \times \frac{\partial(\Delta V3)}{\partial(C_3)} = \Delta Cgs3 \times \frac{\partial(\Delta V3)}{\partial(Cgs3)},$$

it can be obtained that:

$$-\Delta C_3 \times \frac{(VGH - VGL) \times Cgs3}{(C_3 + C_{Data})^2} = \Delta Cgs3 \times \frac{VGH - VGL}{C_3 + C_{Data}}.$$

$$Cgs3 = k \times W_s \times L_s,$$

that is, $Cgs3 = k \times S_{C21}$ and $\Delta Cgs3 = k \times (S_{C12} - S_{C22})$, where k is a process parameter value and is a constant. The value of k is related to factors such as a film thickness and a dielectric constant of the transistor. Because the test transistors are formed by using the same composition process, the value of k in the two formulas is the same. In this case, it is obtained that:

$$S_{C21} - S_{C22} = -(C_{31} - C_{32}) \times \frac{S_{C21}}{C_{31} + C_{Data}}.$$

In conclusion, by making the difference between the channel areas of the first test transistor 191 and the second test transistor 19 satisfy the following relationship:

$$S_{C12} - S_{C22} = -(C_{31} - C_{32}) \times \frac{S_{C21}}{C_{31} + C_{Data}},$$

the impact caused by the capacitance difference ΔCgs3 to the voltage variation on the data line Data can offset the impact caused by the capacitance difference $\Delta C_3$ to the voltage variation on the data line Data.

Figure 18:
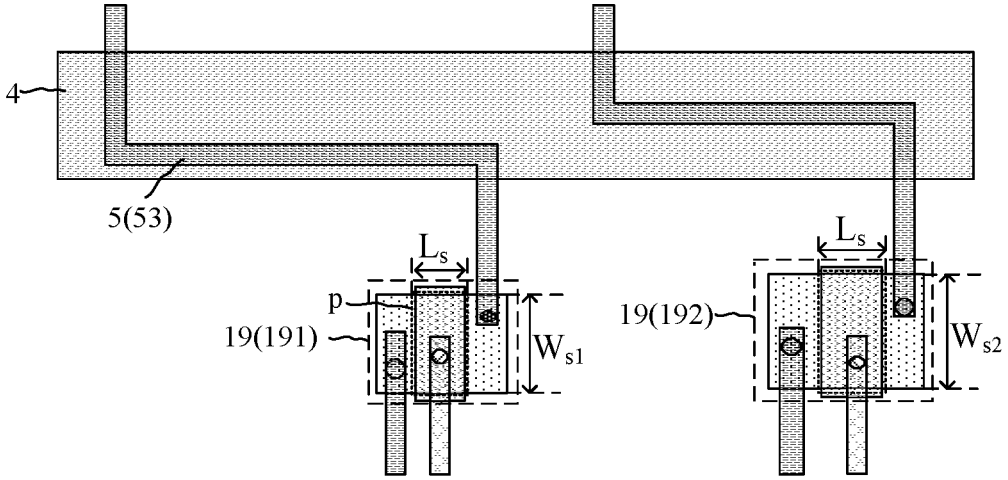
FIG. 18 is a schematic diagram of channel comparison between a first test transistor and a second test transistor according to an embodiment of the present disclosure.

FIG. 18 is a schematic diagram of channel comparison between a first test transistor and a second test transistor according to an embodiment of the present disclosure. As shown in FIG. 18, during channel size design of the test transistors, the channel lengths L s of the test transistors can be the same, and only the channel widths of the first test transistor 191 and the second test transistor 192 are designed to be different from each other.

In this case, the channel width of the first test transistor 191 is $W_{s1}$, the channel width of the second test transistor 192 is $W_{s2}$, and the difference between $W_{s1}$ and $W_{s2}$ satisfies the following relationship:

$$W_{s1} - W_{s2} = -(C_{31} - C_{32}) \times \frac{S_{C21}}{L_s \times (C_{31} + C_{Data})},$$

so that the impact caused by the parasitic capacitance difference ΔCgs3 to the voltage variation on the data line Data can compensate the impact caused by the parasitic capacitance difference $\Delta C_3$ to the voltage variation on the data line Data.

Figure 19:
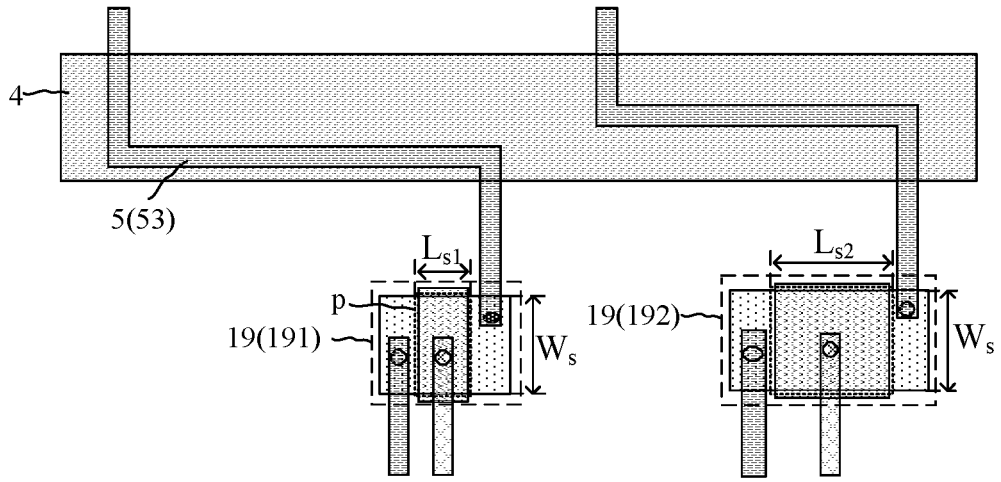
FIG. 19 is a schematic diagram of channel comparison between a first test transistor and a second test transistor according to an embodiment of the present disclosure.

FIG. 19 is a schematic diagram of a channel comparison between a first test transistor and a second test transistor according to an embodiment of the present disclosure. In an embodiment, as shown in FIG. 19, during channel size design of the test transistors, the channel width $W_s$ of the test transistors can be the same, and only the channel lengths of the first test transistor 191 and the second test transistor 192 are designed to be different from each other.

In this case, the channel length of the first test transistor 191 is $L_{s1}$, the channel length of the second test transistor 192 is $L_{s2}$, and the difference between $L_{s1}$ and $L_{s2}$ satisfies the following relationship:

$$L_{s1} - L_{s2} = -(C_{31} - C_{32}) \times \frac{S_{C21}}{W_s \times (C_{31} + C_{Data})},$$

so that the impact caused by the capacitance difference ΔCgs3 to the voltage variation on the data line Data can compensate for the impact caused by the capacitance difference $\Delta C_3$ on the voltage variation on the data line Data.

It can be understood that, in other embodiments of the present disclosure, the channel lengths and the channel widths of the first test transistor 191 and the second test transistor 192 can be adjusted at the same time, so as to design the channel areas of the first test transistor 191 and the second test transistor 192 to be different from each other.

Figure 20:
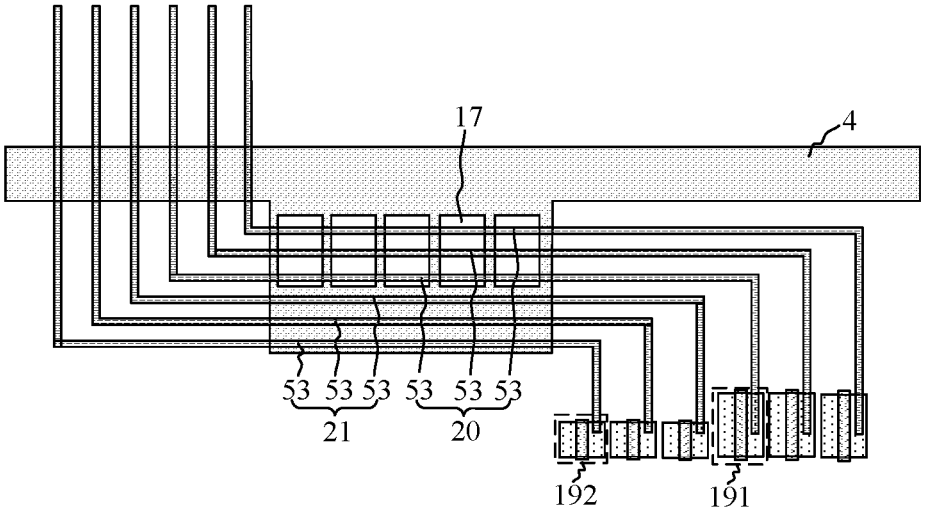
FIG. 20 is a schematic structural diagram of a third trace group and a fourth trace group according to an embodiment of the present disclosure.

FIG. 20 is a schematic structural diagram of a third trace group and a fourth trace group according to an embodiment of the present disclosure. In an implementation, as shown in FIG. 20, the display panel includes a third trace group 20 and a fourth trace group 21. The third trace group 20 and the fourth trace group 21 each include third connection sub-traces 53. The first test transistor 191 is the test transistor coupled to the third connection sub-trace 53 in the third trace group 20, and the second test transistor 192 is the test transistor coupled to the third connection sub-trace 53 in the fourth trace group 21.

The channel area of the first test transistor 191 is $S_{C21}'$, the channel area of the second test transistor 192 is $S_{C22}'$, and $$S'_{C21} - S'_{C12} = -(C'_{31} - C'_{32}) \times \frac{S'_{C21}}{C'_{31} + C_{Data}}.$$

The derivation process of the formula is similar to the derivation process in the foregoing embodiment, and details are not repeated herein. $C_{31}'$ denotes an average value of parasitic capacitances of the third connection sub-traces 53 in the third trace group 20, $C_{32}'$ denotes an average value of parasitic capacitances of the third connection sub-traces 53 in the fourth trace group 21, and $C_{Data}$ denotes a parasitic capacitance of the data line Data.

In the foregoing configuration manner, the first connection sub-traces 51 are classified into different groups, and only the channel areas of the test transistors coupled to different trace groups are designed to be different, while the channel areas of the test transistors coupled to the same trace group are designed to be the same, so that the design difficulty of the transistors can be reduced while the homogeneity of voltage signals transmitted on different data lines Data is improved.

Referring to FIG. 20, the power bus 4 includes a hollowed-out region 17. In the direction perpendicular to the plane of the display panel, the third connection sub-trace 53 in the third trace group 20 at least partially overlaps with the hollowed-out region 17, and the third connection sub-traces 53 in the fourth trace group 21 do not overlap with the hollowed-out regions 17.

In the embodiments of the present disclosure, hollowed-out regions 17 are arranged in the power bus 4 to reduce the load of the power bus 4. After the hollowed-out regions 17 are formed in the power bus 4, at least one third connection sub-trace 53 overlaps with the hollowed-out region 17, and at least one third connection sub-trace 53 does not overlap with the hollowed-out regions 17. For the third connection sub-traces 53 overlapping with the hollowed-out regions 17, these third connection sub-traces 53 have relatively small overlapping areas with the power signal line. Therefore, these third connection sub-traces 53 have relatively low loads, and the voltage signals have a low degree of attenuation when transmitted on these third connection sub-traces 53. For the third connection sub-traces 53 not overlapping with the hollowed-out regions 17, these third connection sub-traces 53 have relatively large overlapping areas with the power signal line. Therefore, these third connection sub-traces 53 have relatively high loads, and the voltage signals correspondingly have a high degree of attenuation when transmitted on these third connection sub-traces 53.

The third connection sub-traces 53 in the first trace group 15 are all third connection sub-traces 53 overlapping with the hollowed-out regions 17, and the third connection sub-traces 53 in the second trace group 16 are all third connection sub-traces 53 not overlapping with the hollowed-out regions 17. On one hand, the third connection sub-traces 53 in the same trace group have similar loads, and when the test transistors coupled to the same trace group adopt the same channel area design, the load difference of the third connection sub-traces 53 in the trace group can still be compensated accurately. On the other hand, loads of third connection sub-traces 53 in different trace groups are significantly different, and by designing the channel areas of the test transistors coupled to different trace groups to be different, the load differences of different third connection sub-traces 53 with significantly different loads can be compensated accurately.

During channel size design of the test transistors, the channel lengths $L_s'$ of the test transistors can be the same, and only the channel widths of the first test transistor 191 and the second test transistor 192 are designed to be different. In this case, the channel width of the first test transistor 191 is $W_{s1}'$, the channel width of the second test transistor 192 is $W_{s2}'$, and the difference between $W_{s1}'$ and $W_{s2}'$ satisfies the following relationship:

$$W'_{s1} - W'_{s2} = -(C'_{31} - C'_{32}) \times \frac{S'_{C21}}{L'_s \times (C'_{31} + C_{Data})},$$

so that the impact caused by the parasitic capacitance difference ΔCgs3' of the two test transistors to the voltage variation on the data line Data can compensate for the impact caused by the parasitic capacitance difference $\Delta C_3'$ of the third connection sub-traces 53 coupled to the two test transistors to the voltage variation on the data line Data.

In an embodiment, the channel widths $W_s'$ of the test transistors can be the same, and only the channel lengths of the first test transistor 191 and the second test transistor 192 are designed to be different from each other. In this case, the channel length of the first test transistor 191 is $L_{s1}'$, the channel length of the second test transistor 192 is $L_{s2}'$, and the difference between $L_{s1}'$ and $L_{s2}'$ satisfies the following relationship:

$$L_{s1}' - L_{s2}' = -(C_{31}' - C_{32}') \times \frac{S_{C21}'}{W_s' \times (C_{31}' + C_{Data})},$$

so that the impact caused by the parasitic capacitance difference ΔCgs3' of the two test transistors to the voltage variation on the data line Data can compensate for the impact caused by the parasitic capacitance difference $\Delta C_3'$ of the third connection sub-traces 53 coupled to the two test transistors to the voltage variation on the data line Data.

It can be understood that, in other embodiments of the present disclosure, the channel lengths and the channel widths of the first test transistor 191 and the second test transistor 192 can be adjusted at the same time, so as to design the channel areas of the first test transistor 191 and the second test transistor 192 to be different from each other.

In an implementation, referring to FIG. 13 and FIG. 20, the power bus 4 includes hollowed-out regions 17, to reduce the load of the power bus 4, thereby reducing the degree of attenuation of the power signal on the power bus 4. In an embodiment, to reduce the loads of the connection traces 5, in the direction perpendicular to the plane of the display panel, at least one connection traces 5 overlaps with the hollowed-out regions 17.

Figure 21:
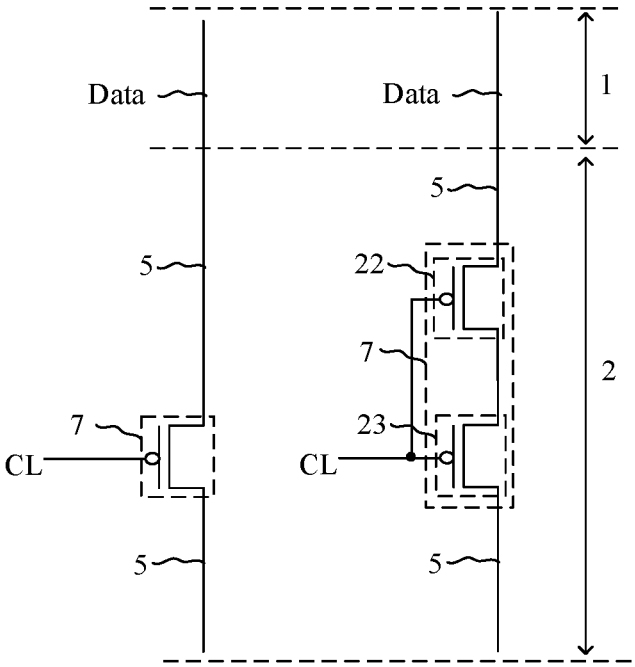
FIG. 21 is a schematic diagram of a circuit structure of a control transistor according to an embodiment of the present disclosure.
Figure 22:
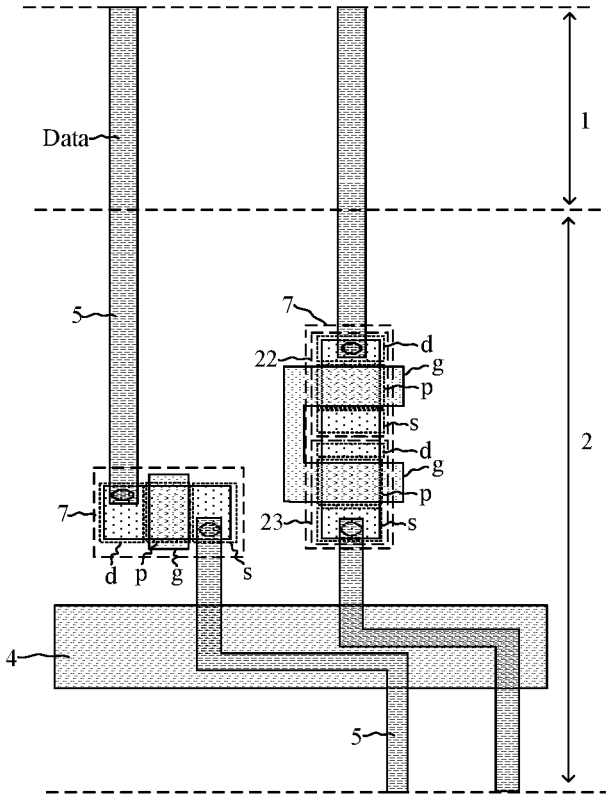
FIG. 22 is a schematic diagram of a film structure of a control transistor according to an embodiment of the present disclosure.

FIG. 21 is a schematic diagram of a circuit structure of a control transistor according to an embodiment of the present disclosure. FIG. 22 is a schematic diagram of a film structure of a control transistor according to an embodiment of the present disclosure. In an implementation, as shown in FIG. 21 and FIG. 22, at least one control transistor 7 include a first sub-transistor 22 and a second sub-transistor 23. A gate of the first sub-transistor 22 and a gate of the second sub-transistor 23 are coupled to a same control signal line CL, and a first electrode of the first sub-transistor 22 is coupled to a second electrode of the second sub-transistor 23.

With the foregoing configuration, in the control circuit 6, at least one control transistor 7 is a double-gate transistor. The gate of the double-gate transistor has a relatively large size, and the channel size covered by the gate is also relatively large. Therefore, in some embodiments of the present disclosure, by designing at least one control transistor 7 to be the double-gate transistor, the coverage area of the gate in the control transistor 7 can be adjusted, thereby adjusting the channel area in the control transistor 7.

Figure 23:
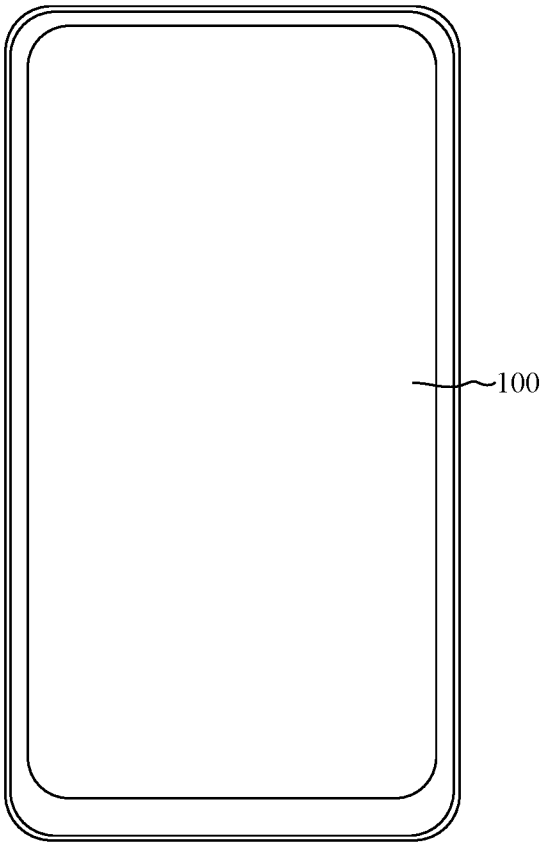
FIG. 23 is a schematic structural diagram of a display apparatus according to an embodiment of the present disclosure.

Based on the same concept, some embodiments of the present disclosure provide a display apparatus. FIG. 23 is a schematic structural diagram of a display apparatus according to an embodiment of the present disclosure. As shown in FIG. 23, the display apparatus includes any one foregoing display panel 100. The structure of the display panel 100 has been described in detail in the foregoing embodiments. Details are not repeated herein. The display apparatus shown in FIG. 23 is for schematic description only. The display apparatus can be any electronic device with a display function, such as a mobile phone, a tablet computer, a notebook computer, an e-book, or a television.

The above descriptions are merely some embodiments of the present disclosure, and are not intended to limit the present disclosure. Any modifications, equivalent replacements, improvements, and the like made within the spirit and principle of the present disclosure shall fall within the scope of the present disclosure.

Finally, it should be noted that the above embodiments are merely intended to describe the technical solutions of the present disclosure, rather than to limit the present disclosure. Although the present disclosure is described in detail with reference to the above embodiments, persons of ordinary skill in the art should understand that they can still make modifications to the technical solutions described in the above examples or make equivalent replacements to some or all technical features thereof, without departing from the essence of the technical solutions in the embodiments of the present disclosure.

What is claimed is:

1. A display panel, having a display region and a non-display region surrounding the display region, and comprising:

data lines located in the display region;

a power bus located in the non-display region;

connection traces located in the non-display region and coupled to the data lines, wherein each of the connection traces at least partially overlaps with the power bus in a direction perpendicular to a plane of the display panel, and has a first area that is an overlapping area between the connection trace and the power bus;

a control circuit located in the non-display region and comprising control transistors, wherein at least one of a first electrode or a second electrode of one of the control transistors is coupled to one of the connection traces; and a first test circuit comprising a first-type test transistor, wherein the first-type test transistor is coupled to the first connection sub-trace, and the first-type test transistor is further coupled to at least one of a test pin or a test control switch signal line;

wherein the control transistors comprise a first control transistor and a second control transistor, wherein the first area of one of the connection traces that is coupled to the first control transistor is different from the first area of another one of the connection traces that is coupled to the second control transistor, and the first control transistor and the second control transistor have different channel areas;

wherein each of the connection traces comprises a first connection sub-trace and a second connection sub-trace;

wherein the control circuit comprises a gating circuit, and the gating circuit comprises gating transistors; one of the gating transistors has a first electrode coupled to a data signal transmission terminal through the first connection sub-trace, and a second electrode coupled to one of the data lines through the second connection sub-trace; and in the direction perpendicular to the plane of the display panel, the first connection sub-trace overlaps with the power bus;

wherein the gating transistors comprise a first gating transistor and a second gating transistor, the first connection sub-trace coupled to the first gating transistor and the first connection sub-trace coupled to the second gating transistor have different first areas, and the first gating transistor and the second gating transistor have different channel areas; and wherein the first gating transistor has a channel area $S_{C11}$, and the second gating transistor has a channel area $S_{C12}$; and $$S_{C11} - S_{C_{12}} = -(C_{11} - C_{12}) \times \frac{W_s \times L_s \times (C_2 + C_{Data})}{(C_{11} + C_2 + C_{Data})^2},$$

where $C_{11}$ denotes a parasitic capacitance of the first connection sub-trace coupled to the first gating transistor, $C_{12}$ denotes a parasitic capacitance of the first connection sub-trace coupled to the second gating transistor, $W_s$ denotes a channel width of the first-type test transistor, $L_s$ denotes a channel length of the first-type test transistor, $C_2$ denotes a parasitic capacitance of the second connection sub-trace, and $C_{Data}$ denotes a parasitic capacitance of one of the data lines.

2. The display panel according to claim 1, wherein the gating transistors have a same channel length $L_D$; and wherein the first gating transistor has a channel width $W_{D1}$, the second gating transistor has a channel width $W_{D2}$, and $$W_{D1} - W_{D2} = -(C_{11} - C_{12}) \times \frac{W_s \times L_s \times (C_2 + C_{Data})}{(C_{11} + C_2 + C_{Data})^2 \times L_D}.$$

3. The display panel according to claim 1, wherein the gating transistors have a same channel width $W_D$; and wherein the first gating transistor has a channel length $L_{D1}$, the second gating transistor has a channel length $L_{D2}$, and $$L_{D1} - L_{D2} = -(C_{11} - C_{12}) \times \frac{W_s \times L_s \times (C_2 + C_{Data})}{(C_{11} + C_2 + C_{Data})^2 \times W_D}.$$

4. A display panel, having a display region and a non-display region surrounding the display region, and comprising:

data lines located in the display region;

a power bus located in the non-display region;

connection traces located in the non-display region and coupled to the data lines, wherein each of the connection traces at least partially overlaps with the power bus in a direction perpendicular to a plane of the display panel, and has a first area that is an overlapping area between the connection trace and the power bus;

a control circuit located in the non-display region and comprising control transistors, wherein at least one of a first electrode or a second electrode of one of the control transistors is coupled to one of the connection traces; and a first test circuit comprising a first-type test transistor, wherein the first-type test transistor is coupled to the first connection sub-trace, and the first-type test transistor is further coupled to at least one of a test pin or a test control switch signal line;

wherein the control transistors comprise a first control transistor and a second control transistor, wherein the first area of one of the connection traces that is coupled to the first control transistor is different from the first area of another one of the connection traces that is coupled to the second control transistor, and the first control transistor and the second control transistor have different channel areas;

wherein each of the connection traces comprises a first connection sub-trace and a second connection sub-trace;

wherein the control circuit comprises a gating circuit, and the gating circuit comprises gating transistors; one of the gating transistors has a first electrode coupled to a data signal transmission terminal through the first connection sub-trace, and a second electrode coupled to one of the data lines through the second connection sub-trace; and in the direction perpendicular to the plane of the display panel, the first connection sub-trace overlaps with the power bus;

wherein the gating transistors comprise a first gating transistor and a second gating transistor, the first connection sub-trace coupled to the first gating transistor and the first connection sub-trace coupled to the second gating transistor have different first areas, and the first gating transistor and the second gating transistor have different channel areas;

wherein the display panel comprises a first trace group and a second trace group, wherein the first trace group comprises the first connection sub-traces of at least two of the connection traces, and the second trace group comprises the first connection sub-traces of another at least two of the connection traces;

wherein the first gating transistor is a gating transistor coupled to one of the first connection sub-traces in the first trace group, and the second gating transistor is a gating transistor coupled to one of the first connection sub-traces in the second trace group; and wherein the first gating transistor has a channel area $S_{C11}'$, and the second gating transistor has a channel area $S_{C12}'$, and $$S'_{C11} - S'_{C12} = -(C'_{11} - C'_{12}) \times \frac{W_s \times L_s \times (C_2 + C_{Data})}{(C'_{11} + C_2 + C_{Data})^2},$$

where $C_{11}'$ denotes an average value of parasitic capacitances of the first connection sub-traces in the first trace group, $C_{12}'$ denotes an average value of parasitic capacitances of the first connection sub-traces in the second trace group, $W_s$ denotes a channel width of the first-type test transistor, $L_s$ denotes a channel length of the first-type test transistor, $C_2$ denotes a parasitic capacitance of the second connection sub-trace, and $C_{Data}$ denotes a parasitic capacitance of one of the data lines.

5. The display panel according to claim 4, wherein the power bus comprises hollowed-out regions; and wherein, in the direction perpendicular to the plane of the display panel, at least one of the first connection sub-traces in the first trace group overlaps with one of the hollowed-out regions, and the first connection sub-traces in the second trace group do not overlap with the hollowed-out regions.

6. The display panel according to claim 4, wherein the gating transistors have a same channel length $L_D'$, the first gating transistor has a channel width $W_{D1}'$, the second gating transistor has a channel width $W_{D2}'$, and $$W'_{D1} - W'_{D2} = -(C'_{11} - C'_{12}) \times \frac{W_s \times L_s \times (C_2 + C_{Data})}{(C'_{11} + C_2 + C_{Data})^2 \times L'_D};$$

or wherein the gating transistors have a same channel width $W_D'$, the first gating transistor has a channel length $L_{D1}'$, the second gating transistor has a channel length $L_{D2}'$, and $$L'_{D1} - L'_{D2} = -(C'_{11} - C'_{12}) \times \frac{W_s \times L_s \times (C_2 + C_{Data})}{(C'_{11} + C_2 + C_{Data})^2 \times W'_D}.$$

7. A display panel, having a display region and a non-display region surrounding the display region, and comprising:

data lines located in the display region;

a power bus located in the non-display region;

connection traces located in the non-display region and coupled to the data lines, wherein each of the connection traces at least partially overlaps with the power bus in a direction perpendicular to a plane of the display panel, and has a first area that is an overlapping area between the connection trace and the power bus; and a control circuit located in the non-display region and comprising control transistors, wherein at least one of a first electrode or a second electrode of one of the control transistors is coupled to one of the connection traces;

wherein the control transistors comprise a first control transistor and a second control transistor, wherein the first area of one of the connection traces that is coupled to the first control transistor is different from the first area of another one of the connection traces that is coupled to the second control transistor, and the first control transistor and the second control transistor have different channel areas;

wherein the connection trace comprises third connection sub-traces;

wherein the control circuit comprises a second test circuit comprising second-type test transistors, wherein one of the second-type test transistors has a second electrode coupled to one of the data lines through one of the third connection sub-traces, and the third connection sub-trace overlaps with the power bus in the direction perpendicular to the plane of the display panel;

wherein the second-type test transistors comprise a first test transistor and a second test transistor that have different channel areas, wherein one of the third connection sub-traces that is coupled to the first test transistor, and another one of the third connection sub-traces that is coupled to the second test transistor have different first areas;

wherein, in a first condition, the first test transistor has a channel area $S_{C21}$, the second test transistor has a channel area $S_{C22}$, and $$S_{C21} - S_{C22} = -(C_{31} - C_{32}) \times \frac{S_{C21}}{C_{31} + C_{Data}},$$

where $C_{31}$ denotes a parasitic capacitance of the one of the third connection sub-traces that is coupled to the first test transistor, $C_{32}$ denotes a parasitic capacitance of the one of the third connection sub-traces that is coupled to the second test transistor, and $C_{Data}$ denotes a parasitic capacitance of one of the data lines; or wherein in a second condition, the display panel comprises a third trace group and a fourth trace group, wherein the third trace group comprises at least two third connection sub-traces of the third connection sub-traces, and wherein the fourth trace group comprises another at least two third connection sub-traces of the third connection sub-traces; the first test transistor is one of the second-type test transistors that is coupled to the one of the at least two third connection sub-traces in the third trace group, and the second test transistor is one of the second-type test transistors that is coupled to the one of the another at least two third connection sub-traces in the fourth trace group; and the first test transistor has a channel area $S_{C21}'$, the second test transistor has a channel area $S_{C22}'$, and $$W_{s1} - W_{s2} = -(C_{31} - C_{32}) \times \frac{S_{C21}}{L_s \times (C_{31} + C_{Data})}.$$

where $C_{31}'$ denotes an average value of parasitic capacitances of the at least two third connection sub-traces in the third trace group, $C_{32}'$ denotes an average value of parasitic capacitances of the another at least two third connection sub-traces in the fourth trace group, and $C_{Data}$ denotes a parasitic capacitance of one of the data lines.

8. The display panel according to claim 7, wherein, in the first condition, the second-type test transistors have a same channel length $L_S$, and the first test transistor has a channel width $W_{s1}$, the second test transistor has a channel width $W_{s2}$, and $$L_{s1} - L_{s2} = -(C_{31} - C_{32}) \times \frac{S_{C21}}{W_s \times (C_{31} + C_{Data})}.$$

9. The display panel according to claim 7, wherein, in the first condition, the second-type test transistors have a same channel width $W_S$, and the first test transistor has a channel length $L_{s1}$, the second test transistor has a channel length $L_{s2}$, and $$S'_{C21} - S'_{C12} = -(C'_{31} - C'_{32}) \times \frac{S'_{C21}}{C'_{31} + C_{Data}},$$

10. The display panel according to claim 7, wherein, in the second condition, the power bus comprises hollowed-out regions, and wherein, in the direction perpendicular to the plane of the display panel, at least one of the at least two third connection sub-traces in the third trace group overlaps with one of the hollowed-out regions, and the another at least two third connection sub-traces in the fourth trace group do not overlap with the hollowed-out region.

11. The display panel according to claim 7, wherein, in the second condition, the second-type test transistors have a same channel length $L_S'$, the first test transistor has a channel width $W_{s1}'$, the second test transistor has a channel width $W_{s2}'$, and $$W'_{s1} - W'_{s2} = -(C'_{31} - C'_{32}) \times \frac{S'_{C21}}{L'_s \times (C'_{31} + C_{Data})};$$

or wherein the second-type test transistors have a same channel width $W_S'$, the first test transistor has a channel length $L_{s1}'$, the second test transistor has a channel length $L_{s2}'$, and $$L'_{s1} - L'_{s2} = -(C'_{31} - C'_{32}) \times \frac{S'_{C21}}{W'_s \times (C'_{31} + C_{Data})}.$$

12. The display panel according to claim 1, wherein the power bus has a hollowed-out region; and wherein, in the direction perpendicular to the plane of the display panel, at least one of the connection traces overlaps with the hollowed-out region.

13. The display panel according to claim 1, wherein at least one of the control transistors comprises a first sub-transistor and a second sub-transistor, wherein a gate of the first sub-transistor and a gate of the second sub-transistor are coupled to a same control signal line, and a first electrode of the first sub-transistor is coupled to a second electrode of the second sub-transistor.

14. A display apparatus, comprising:

the display panel according to claim 1.

15. The display panel according to claim 1, wherein the first control transistor has a channel area $S_{C1}$, and the first area of the one of the connection traces that is coupled to the first control transistor is $S_{O1}$;

wherein the second control transistor has a channel area $S_{C2}$, and the first area of the one of the connection traces that is coupled to the second control transistor is $S_{O2}$; and wherein $S_{O1}>S_{O2}$, and $S_{C1}<S_{C2}$.

* * * * *